US011578939B2

(12) United States Patent
Lesenfants

(10) Patent No.: US 11,578,939 B2
(45) Date of Patent: Feb. 14, 2023

(54) SAFETY MECHANISM FOR FIREARMS

(71) Applicant: Sturm, Ruger & Company, Inc., Southport, CT (US)

(72) Inventor: Marc Lesenfants, Prescott Valley, AZ (US)

(73) Assignee: Sturm, Ruger & Company, Inc.

( * ) Notice: Subject to any disclaimer, the term of this patent is extended or adjusted under 35 U.S.C. 154(b) by 129 days.

(21) Appl. No.: 17/172,778

(22) Filed: Feb. 10, 2021

(65) Prior Publication Data

US 2021/0247157 A1 Aug. 12, 2021

Related U.S. Application Data

(60) Provisional application No. 62/975,247, filed on Feb. 12, 2020.

(51) Int. Cl.
*F41A 17/56* (2006.01)
*F41A 17/46* (2006.01)

(52) U.S. Cl.
CPC ..... *F41A 17/56* (2013.01); *F41A 17/46* (2013.01)

(58) Field of Classification Search
CPC ..... F41A 17/46; F41A 17/56
See application file for complete search history.

(56) References Cited

U.S. PATENT DOCUMENTS 3,633,303 A * 1/1972 Volkmar ..... F41A 17/64 42/70.06
4,282,795 A 8/1981 Beretta
4,590,697 A * 5/1986 Ruger ..... F41A 17/64 42/70.08
5,903,994 A 5/1999 Tange
6,256,918 B1 * 7/2001 Szabo ..... F41A 17/72 89/154
6,543,170 B2 4/2003 Beretta
6,560,909 B2 5/2003 Cominolli
(Continued)

FOREIGN PATENT DOCUMENTS

CN 108917457 A 11/2018

OTHER PUBLICATIONS

Extended European Search Report EP 21156874.6 dated Jun. 7, 2021; pp. 1-7.

*Primary Examiner* — Joshua T Semick
(74) *Attorney, Agent, or Firm* — The Belles Group, P.C.

(57) ABSTRACT

A firearm with dual-acting safety mechanism in one embodiment includes a slide movably carried by a frame, hammer, sear operable to hold the hammer in and release it from a cocked position, and firing mechanism including a trigger and trigger bar which collectively operate to actuate the sear to release the hammer. The safety mechanism includes right and left actuator levers coupled together and cooperating with a safety rocker. The safety rocker is operably interfaced with the trigger bar and pivotably movable between two positions. Moving either actuation lever to activate the safety mechanism rotates the safety rocker which simultaneously both blocks the trigger bar from movement and displaces the trigger bar to disengage the sear which can no longer be actuated via a trigger pull. In one embodiment, the safety mechanism is further operable to lock the slide in the closed breech position when the safety is activated.

30 Claims, 34 Drawing Sheets

(56) References Cited

U.S. PATENT DOCUMENTS

| | | | | |
|---|---|---|---|---|
| 6,588,136 | B2 * | 7/2003 | Baker | F41A 19/48 89/146 |
| 6,718,680 | B2 * | 4/2004 | Roca | F41A 17/46 89/184 |
| 6,948,273 | B2 | 9/2005 | Baker | |
| 7,051,468 | B2 | 5/2006 | Glock | |
| 7,204,051 | B2 | 4/2007 | Thomele et al. | |
| 7,243,453 | B2 | 7/2007 | McGarry | |
| 7,698,845 | B2 | 4/2010 | Hochstrate et al. | |
| 7,726,059 | B2 | 6/2010 | Pikielny | |
| 8,033,043 | B2 | 10/2011 | McGarry | |
| 8,127,481 | B2 | 3/2012 | Rozum et al. | |
| 8,132,496 | B2 | 3/2012 | Zukowski | |
| 8,276,502 | B1 | 10/2012 | Wright | |
| 8,464,455 | B2 * | 6/2013 | Kallio | F41A 17/74 42/70.06 |
| 8,499,482 | B1 | 8/2013 | Di Trolio | |
| 8,677,665 | B1 | 3/2014 | Huber | |
| 8,677,667 | B2 | 3/2014 | Tatum | |
| 8,683,729 | B2 | 4/2014 | Bova | |
| 9,222,745 | B2 * | 12/2015 | Kallio | F41A 17/72 |
| 9,383,153 | B2 * | 7/2016 | Nebeker | F41A 17/72 |
| 9,587,897 | B1 | 3/2017 | Huang et al. | |
| 9,874,417 | B2 * | 1/2018 | Zajk | F41A 19/32 |
| 10,030,927 | B1 * | 7/2018 | Theiss | F41A 19/12 |
| 10,126,086 | B2 | 11/2018 | Smith | |
| 2008/0163531 | A1 | 7/2008 | Zukowski et al. | |
| 2010/0170131 | A1 | 7/2010 | Zukowski | |
| 2018/0100712 | A1 | 4/2018 | Tompkins | |
| 2019/0033028 | A1 | 1/2019 | Folk et al. | |

* cited by examiner

SAFETY MECHANISM FOR FIREARMS

CROSS-REFERENCE TO RELATED APPLICATIONS

The present application claims the benefit of priority to U.S. Provisional Application No. 62/975,247 filed Feb. 12, 2020; the entirety of which is incorporated herein by reference.

BACKGROUND

The present invention generally relates to firearms, and more particularly to user-actuated safety mechanisms for firearms.

Manual safeties for firearms are intended to reduce the chance of accidental discharge by disabling fire control components in the event a user fails to exercise proper firearm handling procedures. This can be achieved in numerous ways to block various components of the trigger-actuated firing mechanism. Many safeties act to disable only a single aspect of the firing mechanism.

Improvements in safeties are desired.

SUMMARY

According to aspects of the present disclosure, an auto-loading firearm with manually-actuated safety mechanism and a related method of operation are provided. The manual safety mechanism disclosed herein acts both to selectively disconnect the operable coupling between the trigger bar and sear necessary to discharge the firearm, in addition to blocking movement of the trigger bar independently of the sear disconnect. This advantageously forms a dual-acting safety mechanism to block discharge of the firearm in two different ways when the safety is activated for added security. In addition, the dual-acting safety mechanism may also be configured to lock the slide in its forward closed breech position, thereby preventing the user from manually retracting the slide when the safety mechanism is activated. The safety mechanism may be ambidextrous allowing the user to activate or deactivate the safety from either the right or left sides of the firearm to accommodate different users.

A firearm according to the present disclosure therefore includes a manually operated safety mechanism configured to selectively arrest the firing control mechanism. The safety mode selector or actuator lever accessible from the rear of the firearm is pivotably alterable between two positions allowing selection of a "safe" mode or position in which the firing mechanism is disabled, and a "fire" mode or position in which the firing mechanism is enabled to discharge the firearm. The firearm may be an auto-loading pistol in one embodiment as illustrated herein; however, the present dual acting safety mechanism is broadly applicable for use in long guns such as rifles and shotguns.

In one aspect, a firearm with dual-acting safety mechanism comprises: a longitudinal axis; a frame; a striking member movably disposed in the frame, the striking member moveable between a rearward cocked position and a forward firing position; a sear pivotably disposed in the frame, the sear configured to hold the hammer in the rearward cocked position; a trigger mechanism comprising a trigger and trigger bar operably coupled to sear, the trigger bar movable to actuate the sear for releasing the striking member from the cocked position via a trigger pull to discharge the firearm; and a manually-operated safety mechanism comprising at least one manually movable first actuator lever pivotably mounted to the firearm and operably interfaced with the trigger bar, and a pivotably movable safety rocker operably coupled with the first actuator lever, the safety rocker engageable with the trigger bar and actuatable via moving the first actuator lever; wherein the safety mechanism is changeable via moving the first actuator lever between: (1) a fire position in which the sear engages the trigger bar to discharge the firearm in response to the trigger pull; and (2) a safe position in which the first actuator lever disengages the trigger bar from the sear and rotates the safety rocker to block movement of the trigger bar each of which prevents the firearm from being discharged in response to the trigger pull. In various embodiments, the striking member may be a hammer pivotably mounted about a hammer pin in the frame or a linearly movable striker. In some embodiments, the sear, trigger mechanism, and safety mechanism may be mounted in a firing control insert removably mounted to the frame.

According to another aspect, an auto-loading pistol with dual-acting safety mechanism comprises: a longitudinal axis; a frame; a firing control insert configured for removable mounting to the frame; a slide movably mounted to the firing control insert for movement between a forward closed breech position and a rearward open breech position; a firing mechanism mounted to the firing control insert, the firing mechanism comprising a hammer pivotably movable between forward firing and rearward cocked positions, a rotatable sear operable to retain the hammer in and release the hammer from the cocked position, a trigger, and a trigger bar operably linking the trigger to the sear, the trigger bar movable to rotate the sear and release the hammer from the cocked position via a trigger pull to discharge the firearm; and an ambidextrous manual safety mechanism comprising a pivotable first actuator lever operably coupled with the trigger bar, a pivotable second actuator lever operably coupled to first actuator lever, and a pivotably movable safety rocker operably coupled with the first actuator lever; wherein the safety mechanism is manually changeable via moving the first or second actuator levers between: (1) a fire position in which the sear engages the trigger bar to discharge the firearm in response to the trigger pull; and (2) a safe position in which the safety mechanism disengages the trigger bar from the sear and rotates the safety rocker to block movement of the trigger bar each of which prevents the firearm from being discharged in response to the trigger pull.

According to another aspect, a method for operating a firearm safety mechanism is provided. The method comprises: providing a firearm including a longitudinal axis, a striking member movable between rearward cocked and forward firing positions, a sear operable to retain the striking member in the cocked position, a trigger bar operably linking the sear to a trigger such that pulling the trigger moves the trigger bar which in turn rotates the sear to release the striking member for discharging the firearm; setting a safety mechanism comprising an actuator lever operably interfaced with the trigger bar in a fire position, the trigger bar being in a first position engageable with the sear to actuate the sear in response to pulling the trigger; moving the actuator lever to place the safety mechanism in a safe position; rotating a safety rocker of the safety mechanism with the actuator lever; moving the trigger bar to a second position via rotating the safety rocker, the trigger bar not being engageable with the sear to actuate the sear in response to a trigger pull; and simultaneously blocking movement of the trigger bar with the safety rocker. In various embodiments, the striking member may be a hammer pivotably mounted about a hammer pin in the frame or a linearly movable striker. In some embodiments, the sear, trigger mechanism, and safety mechanism may be mounted in a firing control insert removably mounted to the frame.

BRIEF DESCRIPTION OF THE DRAWINGS

The features of the exemplary embodiments will be described with reference to the following drawings where like elements are labeled similarly, and in which.

Figure 1:
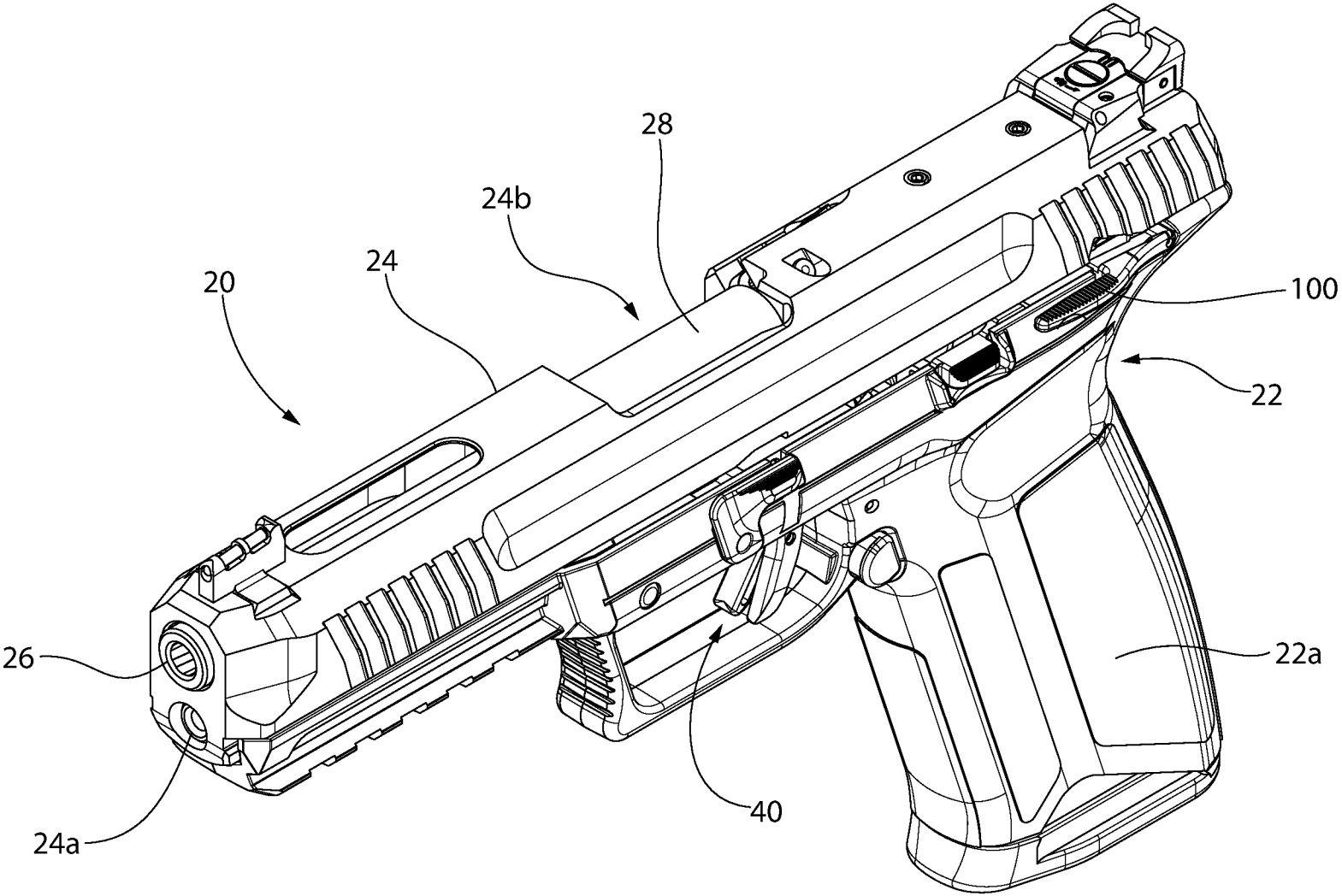
FIG. 1 is a left side perspective view of one exemplary embodiment of a firearm in the form of a pistol with a dual-acting safety mechanism according to the present disclosure.
Figure 2:
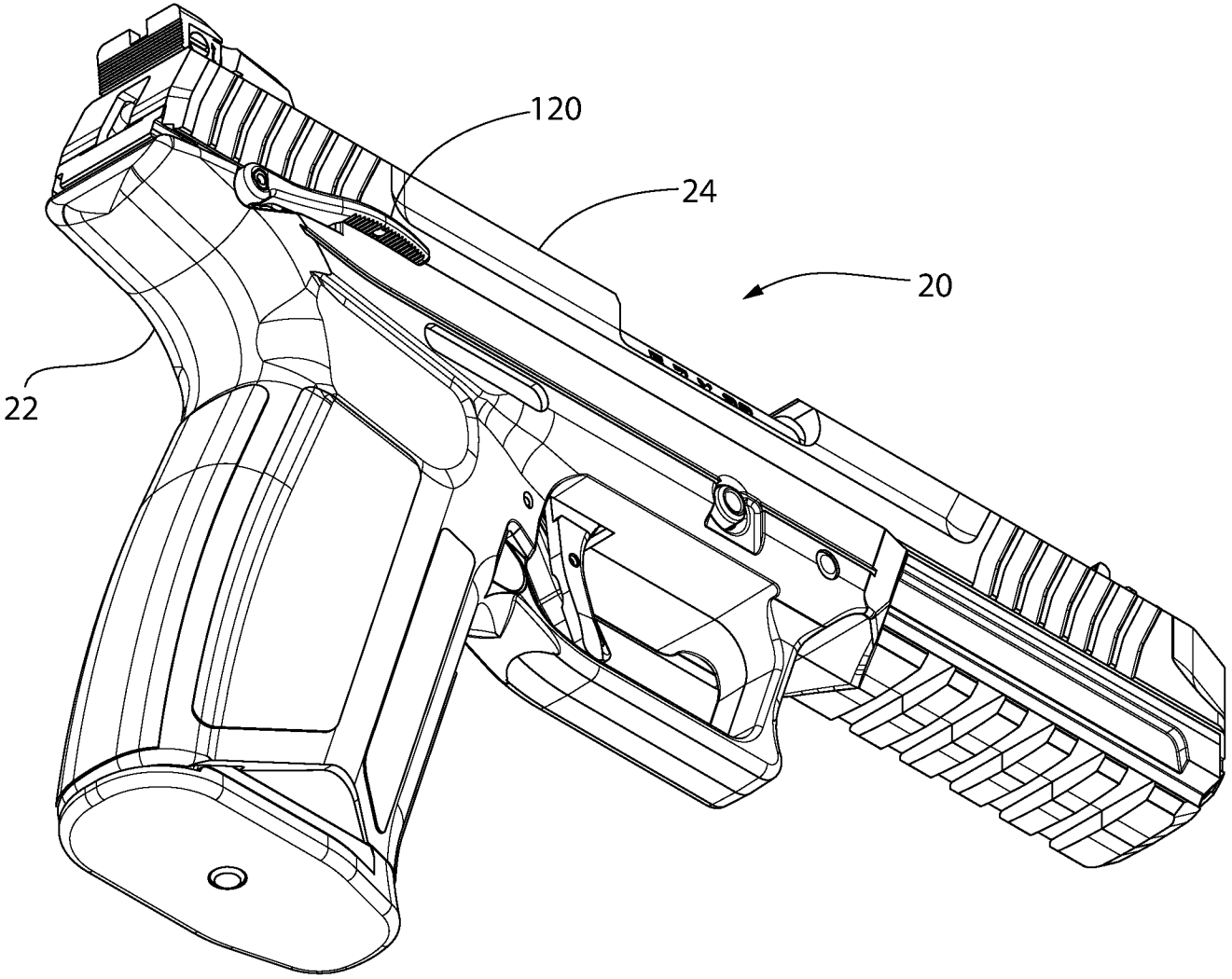
FIG. 2 is a right side perspective view thereof.
Figure 3:
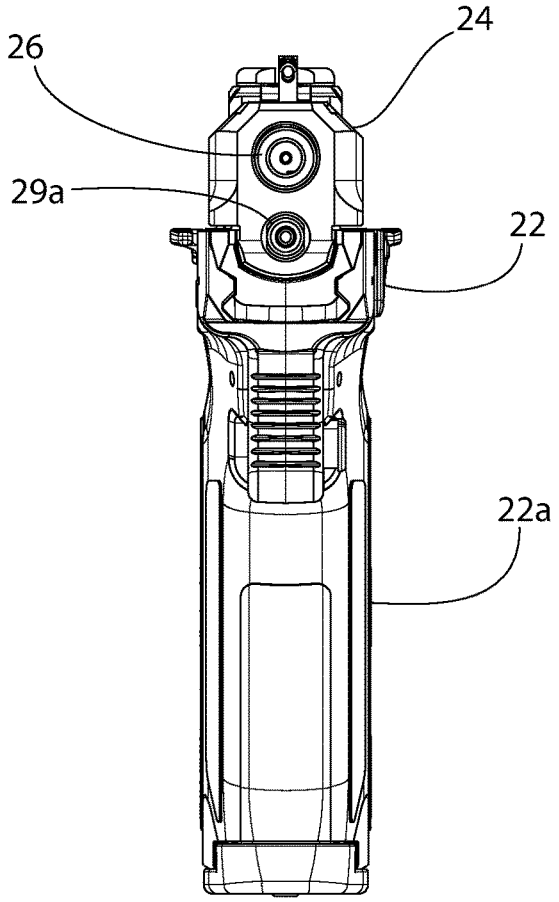
FIG. 3 is a front view thereof.
Figure 4:
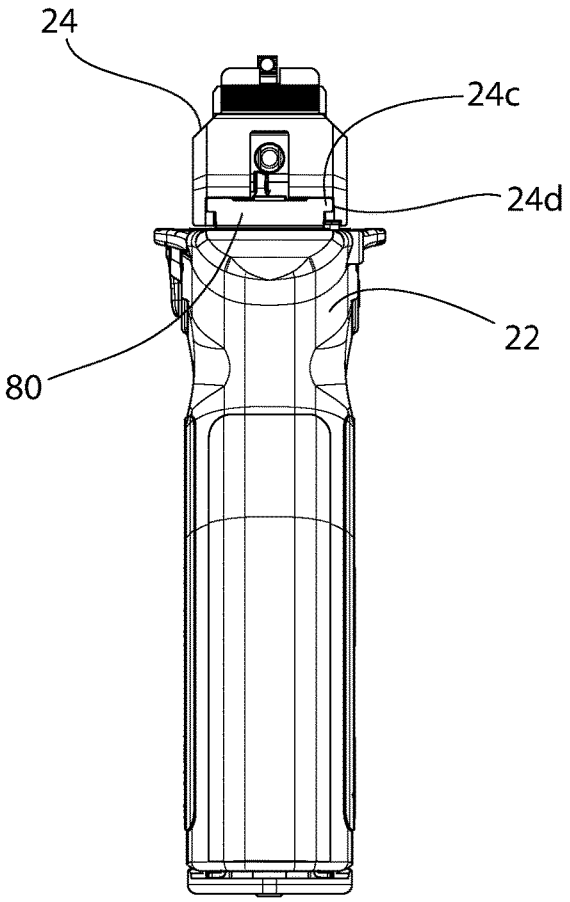
FIG. 4 is a rear view thereof.

All drawings shown herein are schematic and not necessarily to scale. A reference herein to a figure by number which may include several related figures having the same number but different alphabetical suffixes shall be construed as a reference to all sub-part figures unless explicitly noted otherwise. Features appearing numbered in some figures but un-numbered in other figures are the same features unless noted otherwise herein.

DETAILED DESCRIPTION

The features and benefits of the invention are illustrated and described herein by reference to exemplary ("example") embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise. Moreover, the features and benefits of the invention are illustrated by reference to the exemplary embodiments. Accordingly, the invention expressly should not be limited to such exemplary embodiments illustrating some possible non-limiting combination of features that may exist alone or in other combinations of features; the scope of the invention being defined by the claims appended hereto.

An exemplary auto-loading firearm incorporating an embodiment of the dual functioning safety mechanism according to principles of the present invention will now be described with reference to a semi-automatic firearm 20 in the form of a pistol. The principles and features of the embodiments disclosed herein, however, may be embodied with equal benefit in other types of auto-loading firearms using any caliber ammunition and including long guns such as rifles or shotguns. Accordingly, the invention is not limited in its applicability or scope to pistols alone as described herein.

Referring initially now to FIGS. 1-9 and 23-24, firearm 20 includes a frame 22 having a rear downwardly extending grip portion 22*a* for grasping and a longitudinally-extending cavity 22*b* which opens upwards and receives fire control insert 80 removably mounted therein. Fire control insert 80 supports various firing control mechanism components which advantageously may be mounted therein prior to inserting the insert into the frame 22 to facilitate assembly of the pistol. Accordingly, the fire control insert 80 with firing control mechanism components is mountable in frame 22 as a unit. Advantageously, this allows the firing control components to be pre-mounted in the insert 80 in a simplified and readily more accessible manner rather than mounting the components individually in the frame. In other embodiments, the firing control mechanism components may be directly mounted in frame 22 without use of an insert 80. The invention is therefore expressly not limited to either arrangement.

Slide 24 is slideably mounted on firearm 20, and in one embodiment on fire control insert 80 and/or frame 22 via a support rail and groove system for axial reciprocating movement forwards and rearwards thereon. In one embodiment, longitudinal grooves 24*d* which open inwards may be formed on slide 24 and firing control insert 80 may include corresponding flanged rails 24*c* which protrude outwardly to slideably engage the grooves. Such systems are known and understood by those in the art without further elaboration. A recoil spring 29 operably associated with slide 24 and mounted on a guide rod 29*a* acts to return the slide to the forward position shown in FIGS. 9 and 10 after discharging firearm 20. A magazine 50 may be removably inserted into frame 22 and fire control insert 80. The frame 22 may define a magazine well 21 with open bottom configured for receiving and supporting magazine 50 therein. Magazine 50 is sized and configured for holding a stack of and dispensing a plurality of cartridges C via magazine spring 50*a*. Slide 24 includes an ejection port 24*b* for ejecting spent cartridge casings from the firearm when the action is cycled in the usual manner.

Firearm 20 further includes a barrel 26 that is movably disposed at least partially inside slide 24 and longitudinal axis LA defining an axial direction. Transverse directions are defined obliquely or perpendicularly to axis LA. Axially elongated barrel 26 includes front muzzle end 26*b*, rear breech end 26*c*, and axial bore 26*a* extending between the ends. Longitudinal axis LA of firearm 20 is coaxially aligned with and defined by the axial centerline of bore 26*a* of barrel 26. The bore may be rifled as shown. Barrel 26 includes a rear chamber block 28 adjacent breech end 26*c* defining rearwardly open chamber 30 therein configured for receiving a cartridge. Breech area 23 is defined at the rear breech end of barrel 26 and chamber 30 within in the slide 24 for chambering cartridges C uploaded from magazine 50 when the action is cycled.

Slide 24 includes a breech block defining a frontal breech face 24*a* which is axially moveable with the slide in relation to the chamber 30 to alternatingly form an open or closed breech in a manner well known in the art. The breech is shown closed in FIGS. 7A-B with front breech face on slide abutted against rear breech end of the barrel/chamber. Breech face 24*a* supports the base of a chambered cartridge during firing. Barrel 26 is moveable rearwards with slide 24 on fire control insert 80 under recoil after discharging firearm 20 for at least a short distance until the barrel movement is arrested by cam slot 26*e* formed in barrel 26 engaging stationary transverse cam pin 26*d* fixedly mounted in frame 22 and/or firing control insert 80 in one embodiment. In other embodiments, the barrel 26 may remain stationary after discharging the firearm relative to the slide. Slide is movable rearwards on frame 22 automatically under recoil when discharging the firearm or when manually cycling the action.

Figure 13:
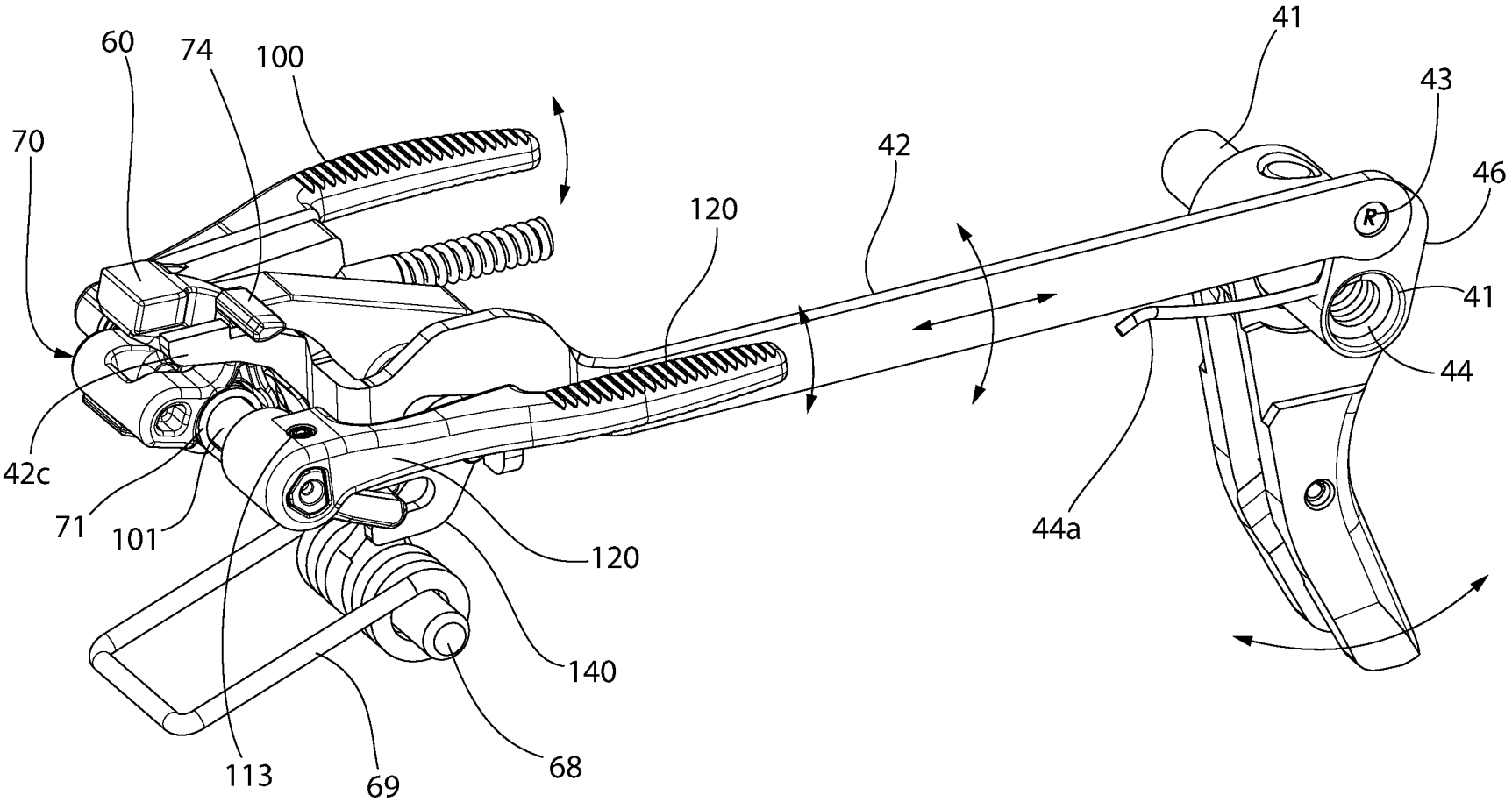
FIG. 13 is a right rear perspective view thereof.
Figure 14:
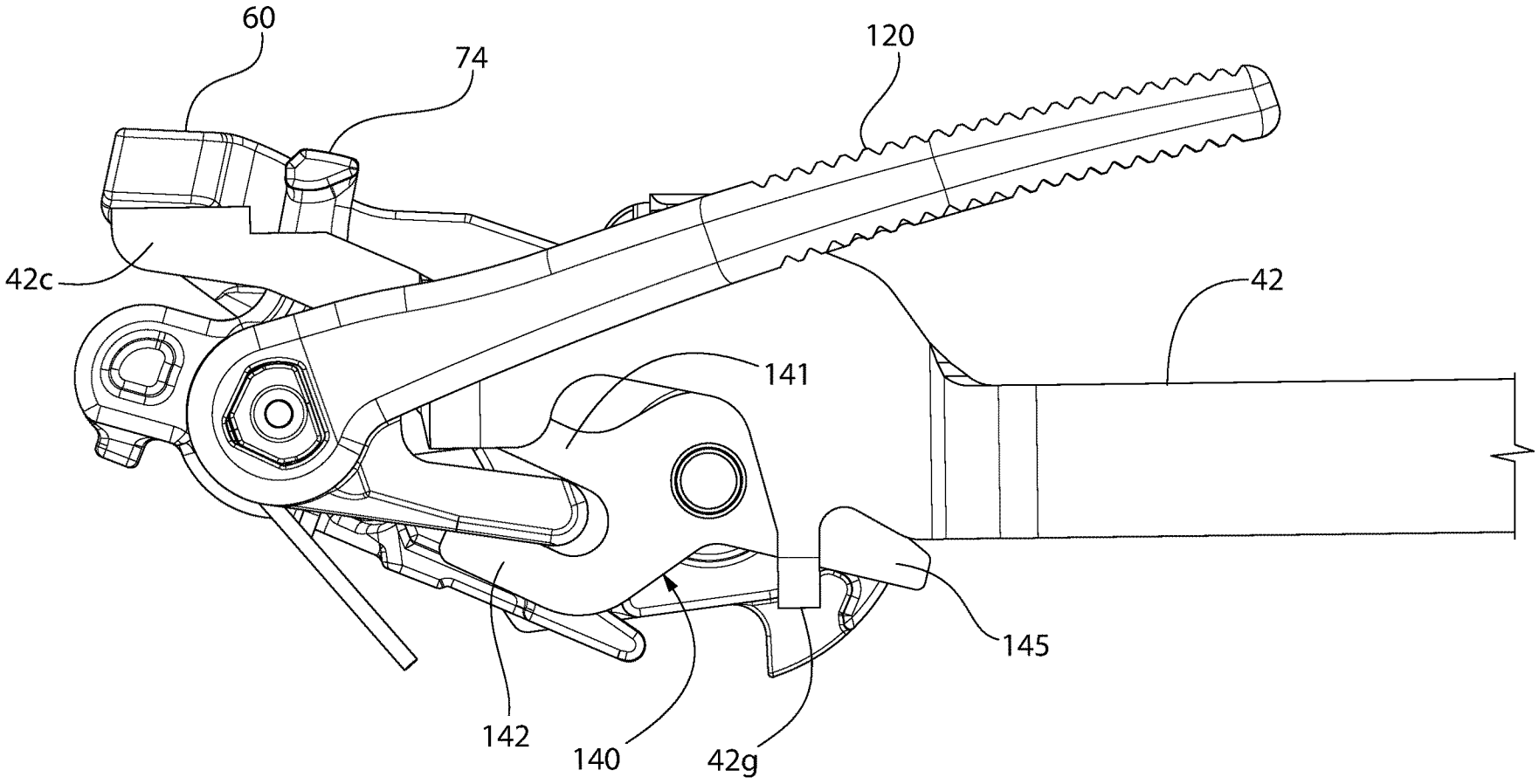
FIG. 14 is a right side view of the safety mechanism in a "safe" position.
Figure 15:
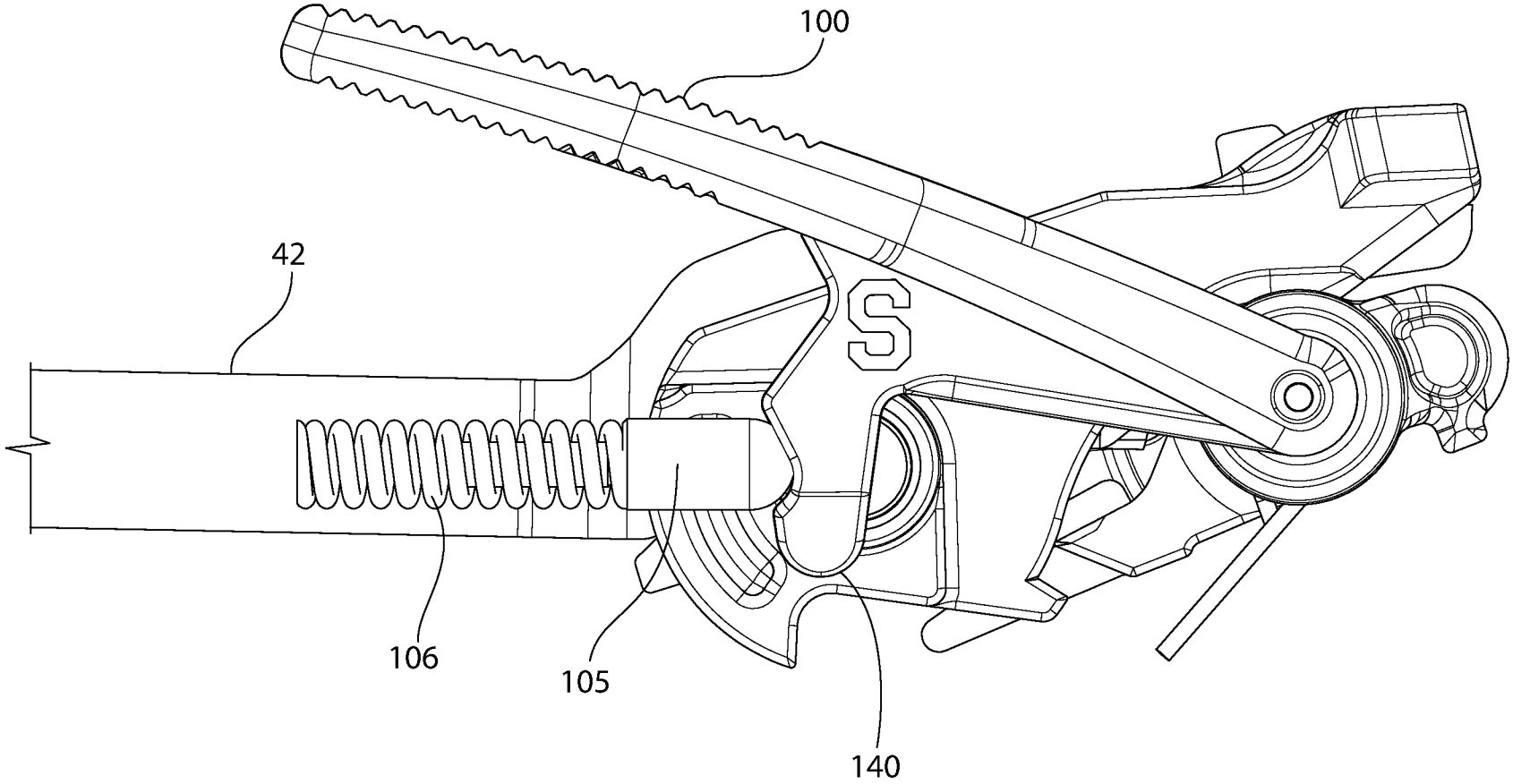
FIG. 15 is a left side view thereof.
Figure 16:
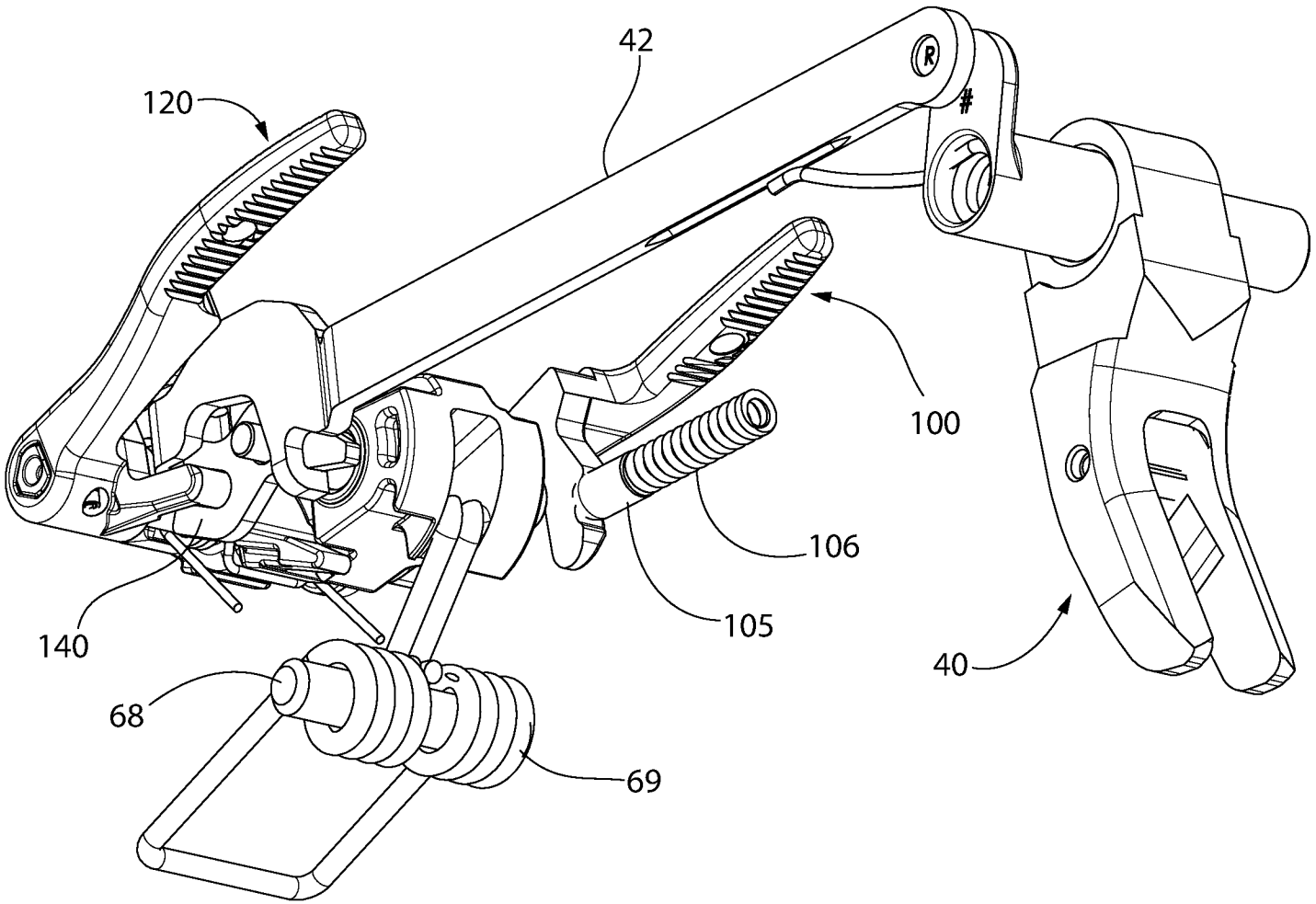
FIG. 16 is right bottom perspective view thereof.
Figure 17:
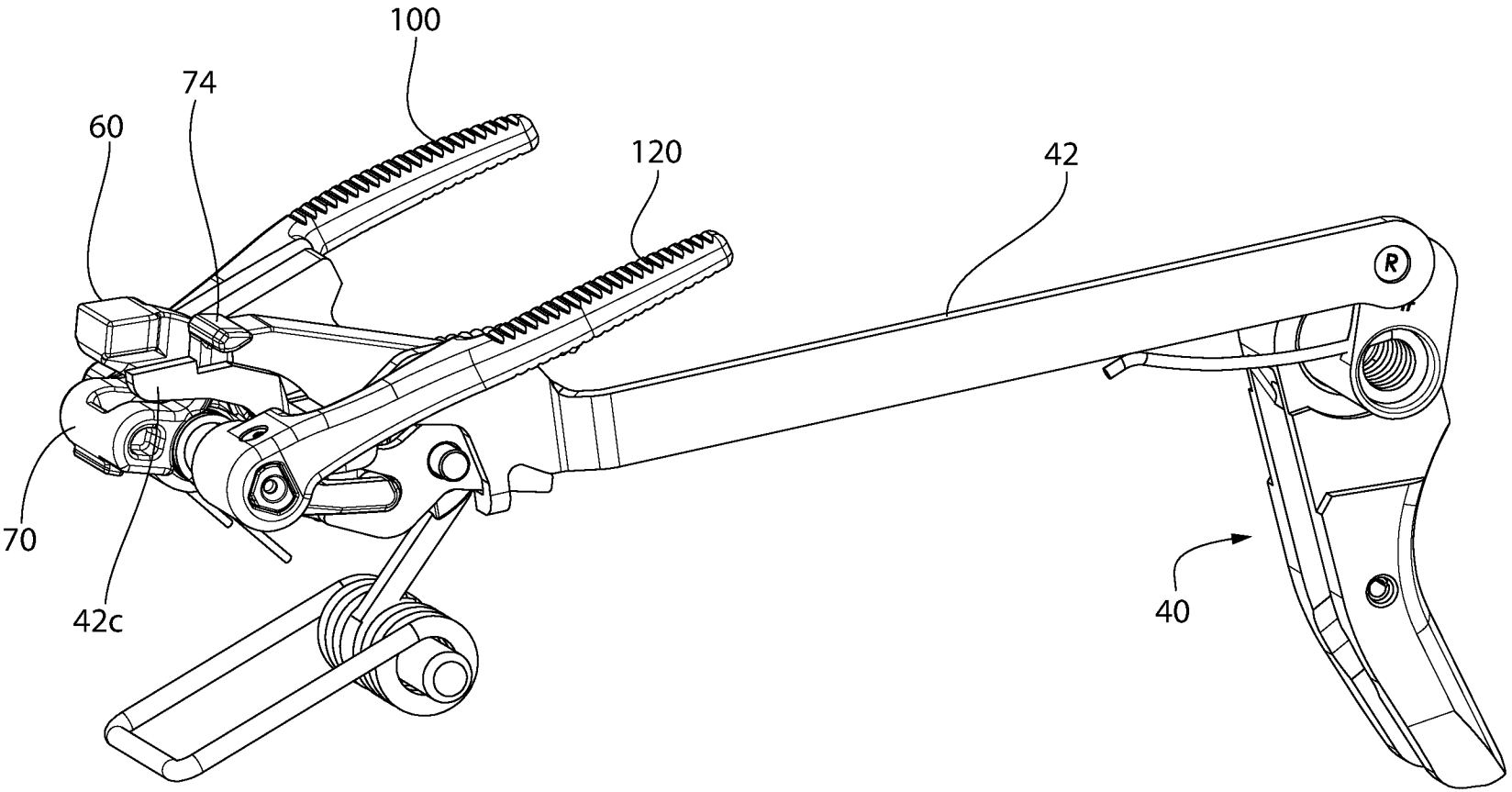
FIG. 17 is a right rear perspective view thereof.
Figure 18:
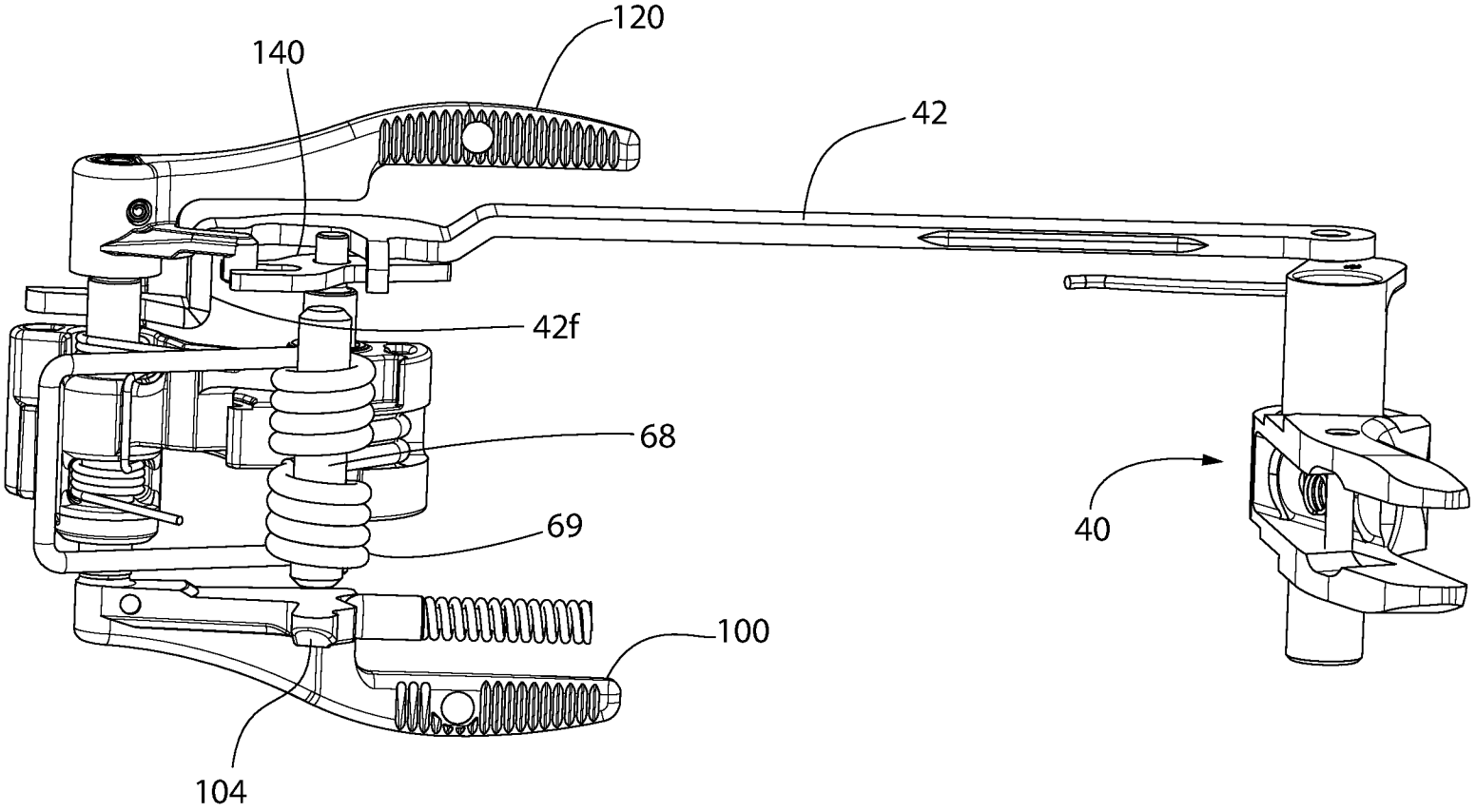
FIG. 18 is bottom perspective view thereof.
Figure 24:
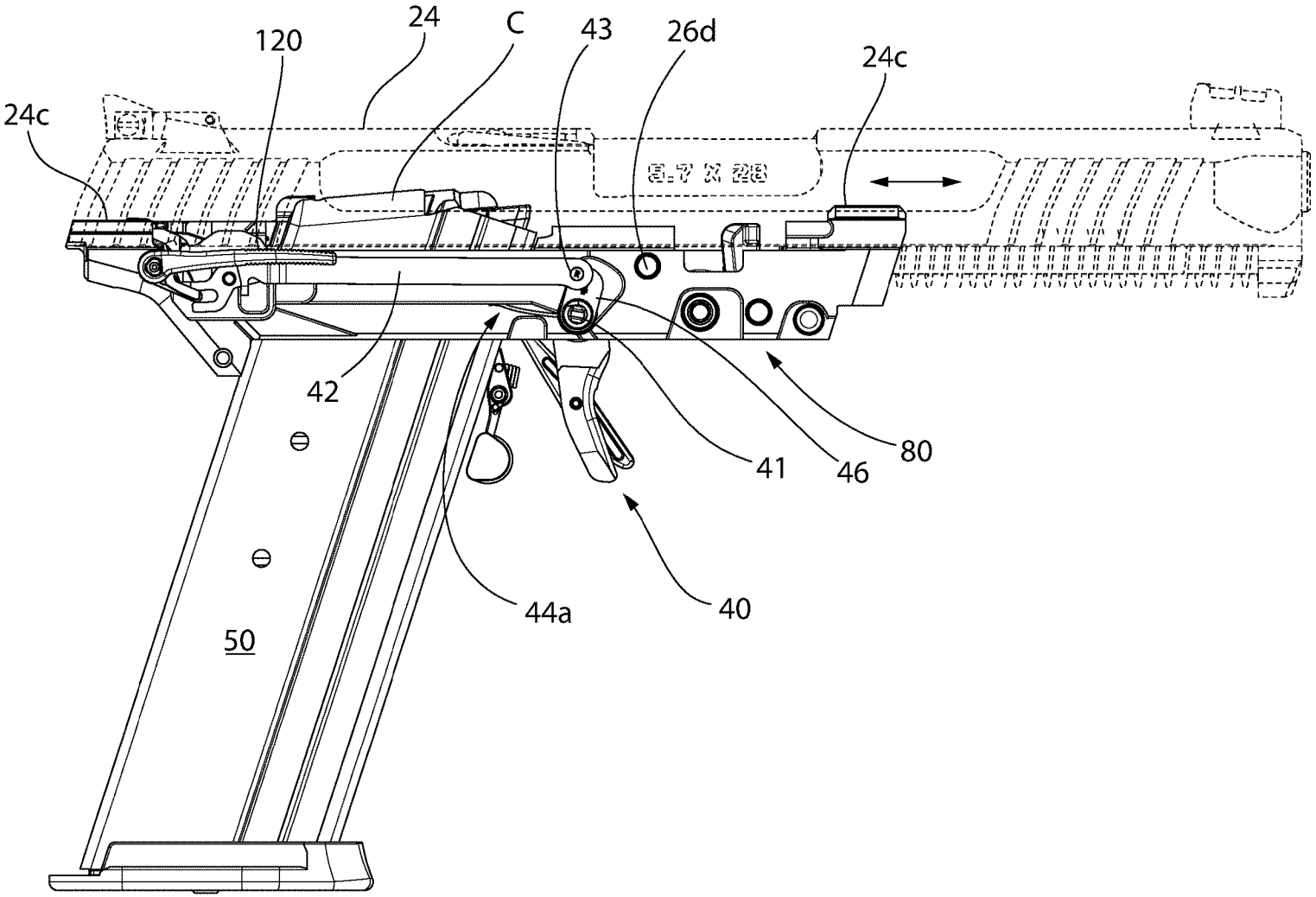
FIG. 24 is a right side view thereof.

Referring generally to FIGS. 1-22, the firing control mechanism in one embodiment includes a trigger mechanism or assembly including a trigger 40 pivotally mounted in frame 22 to fire control insert 80 via transverse trigger pin 41, and an axially (longitudinally) movable trigger bar 42 pivotally coupled to the trigger via transverse pivot pin 43 on an upright trigger pivot extension 46 (see, e.g. FIGS. 13 and 24). Pivot extension 46 may be disposed on or integrally formed with the trigger pivot pin 41 in some embodiments. Pulling trigger 40 rearward moves trigger bar 42 axially forward. The trigger 40 may be a dual trigger assembly in one embodiment including an outer trigger member and an inner safety trigger member pivotably movable relative thereto. Firing the firearm via a trigger pull in normal fashion requires each trigger to be intentionally pulled fully rearward. Operation of such safety trigger systems is well known in the art without further elaboration.

An axially movable spring-biased firing pin 27 is supported by slide 24 and positioned for rearward retraction and forward movement when struck by a spring-biased striking member to strike a chambered cartridge C to discharge the firearm 20. Firing pin 27 is biased rearward toward a reset position by firing pin spring 27*a*. Firing pin spring 27*a* may be positioned concentrically around the forward portion of the axially elongated firing pin body. Spring 27*a* may be a helical compression coil spring in one embodiment, or other suitable type spring operable to bias the firing pin rearwards away from the chamber 30. The firing pin may have a diametrically narrowed front end and tip configured to contact the rear of cartridge C for detonating the cartridge, whereas the rear end of the firing pin may be diametrically enlarged relative thereto. The rear end may be exposed in a rear cavity 27*b* of the slide 24 where it can be reached and struck by the spring-biased striking member when released from engagement by sear 70. This drives the firing pin forward to strike and detonate the cartridge C in the usual manner known in the art. Cartridge C may be a centerfire cartridge in some embodiment; however, in other embodiments of the firearm the cartridge may be a rimfire cartridge.

In one non-limiting embodiment as illustrated, the spring-biased striking member may be a pivotably movable hammer 60 which is acted upon by the sear 70, which selectively retains or releases the hammer from the rearward cocked position in response to a trigger pull. Embodiments of the dual-acting safety mechanism, however, are expressly not limited to this form of striking member. In other possible embodiments, the spring-biased striking member may be a linearly movable striker such as those disclosed in commonly-owned U.S. Pat. No. 9,383,153; which is incorporated herein by reference in its entirety. The sear acts on a downwardly depending catch protrusion of the striker to selectively retain or release the striker. The striker replaces the firing pin and directly strikes a chambered cartridge. The dual-acting safety mechanism disclosed herein is therefore readily usable with either of the foregoing forms of striking members and therefore not limited in its applicability to a single means for striking a chambered cartridge to discharge the firearm.

Figure 5:
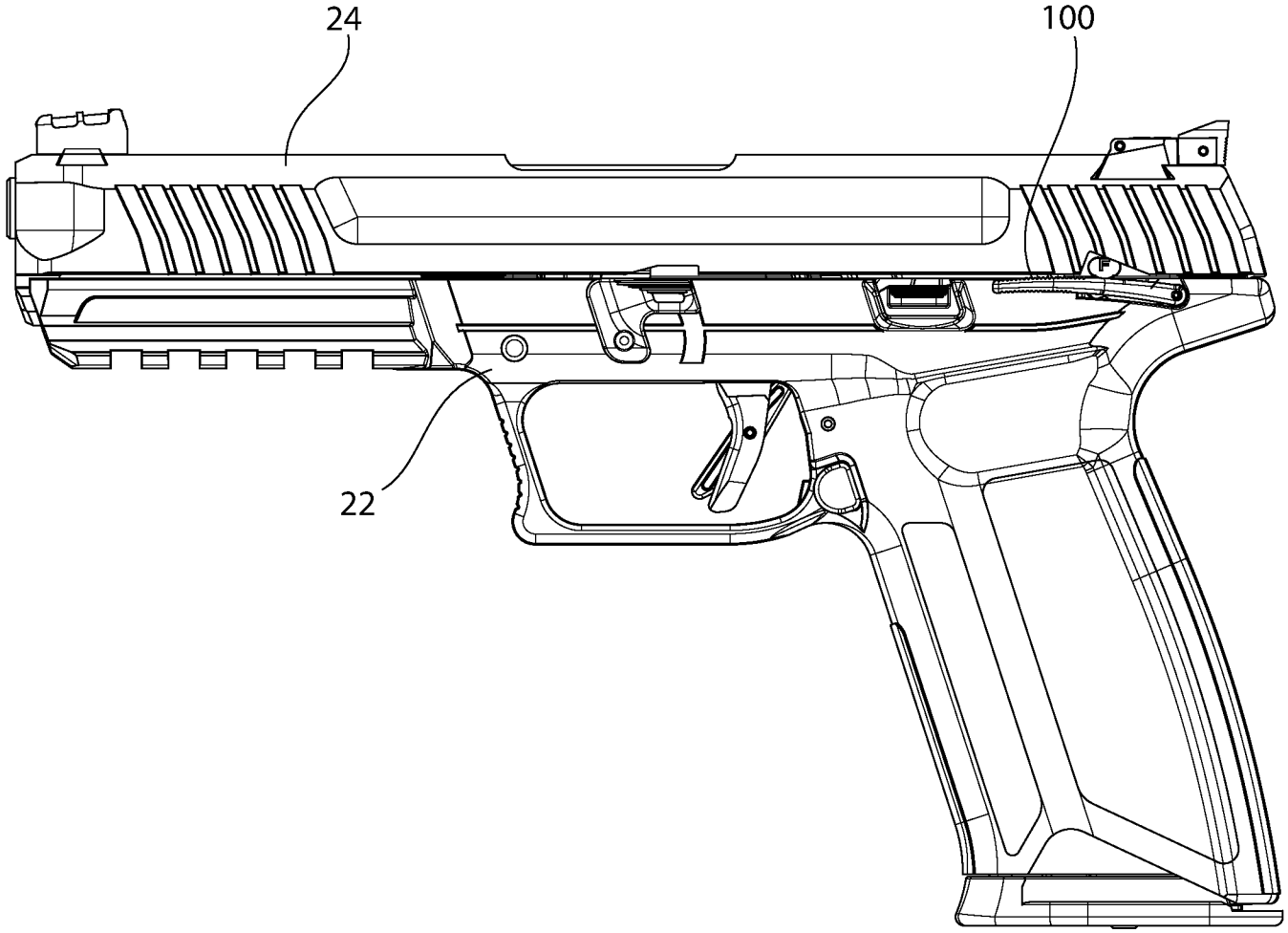
FIG. 5 is a left side view thereof.
Figure 6:
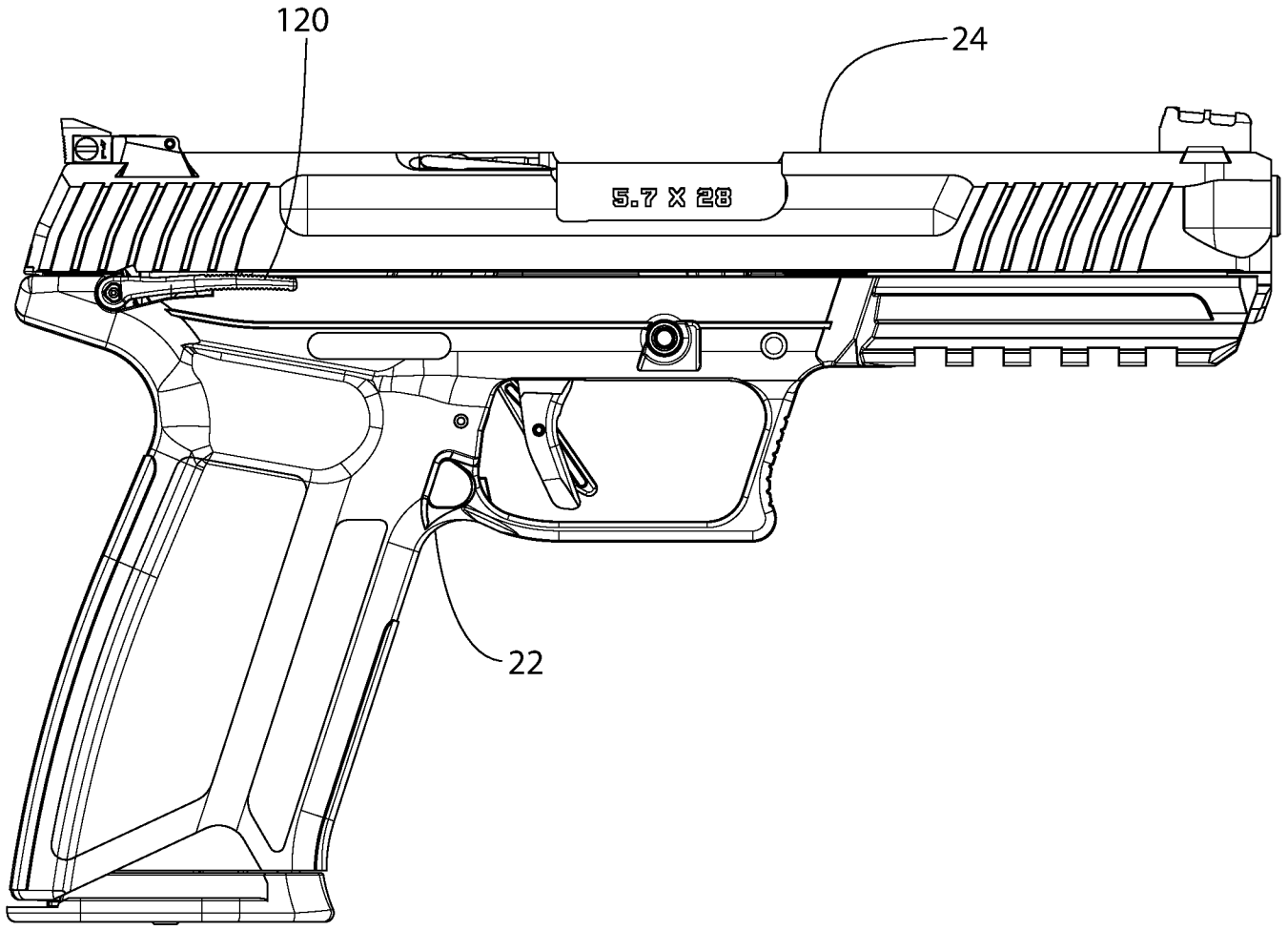
FIG. 6 is a right side view thereof.
Figure 7A:
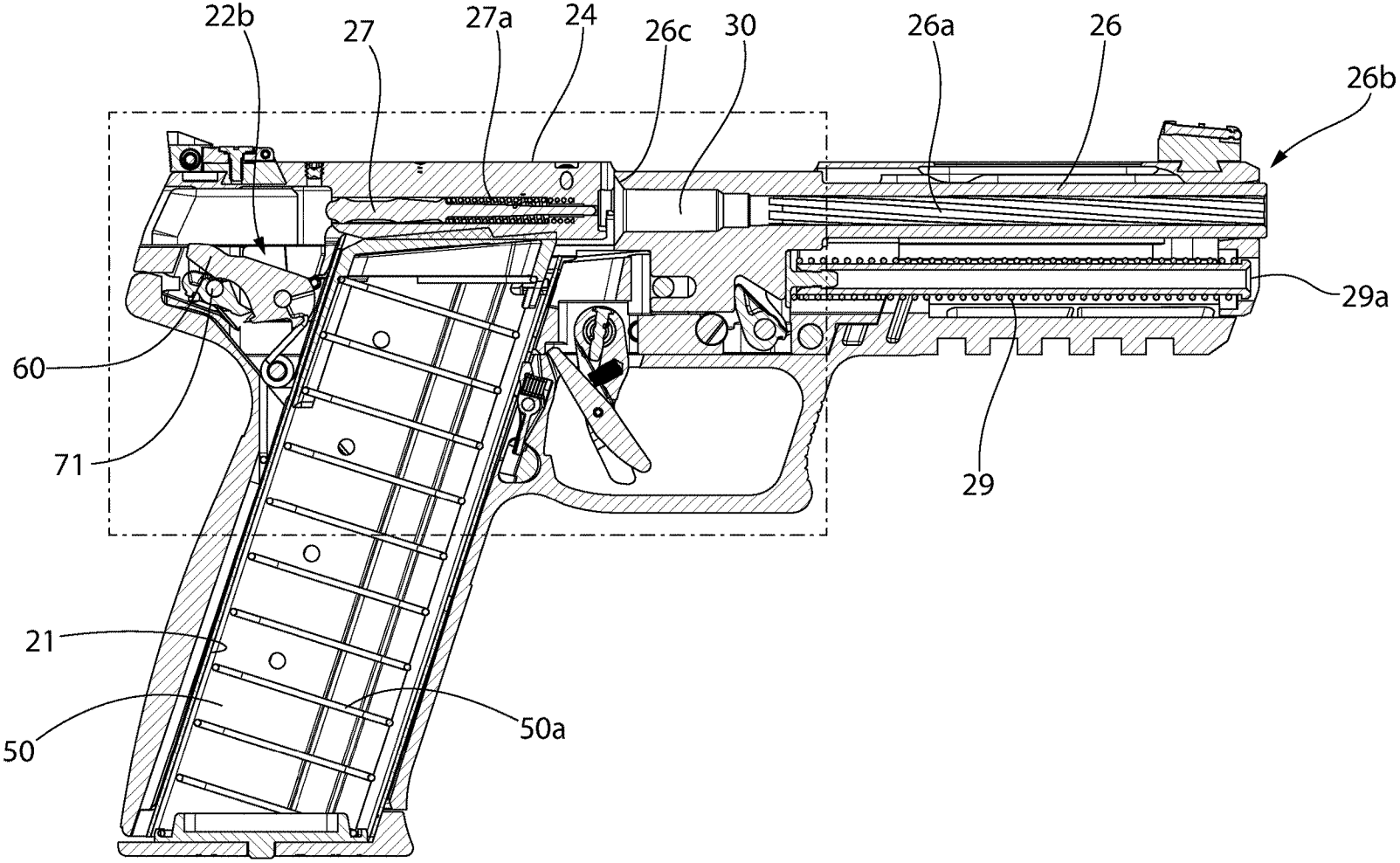
FIG. 7A is a right side longitudinal cross-sectional view thereof.
Figure 7B:
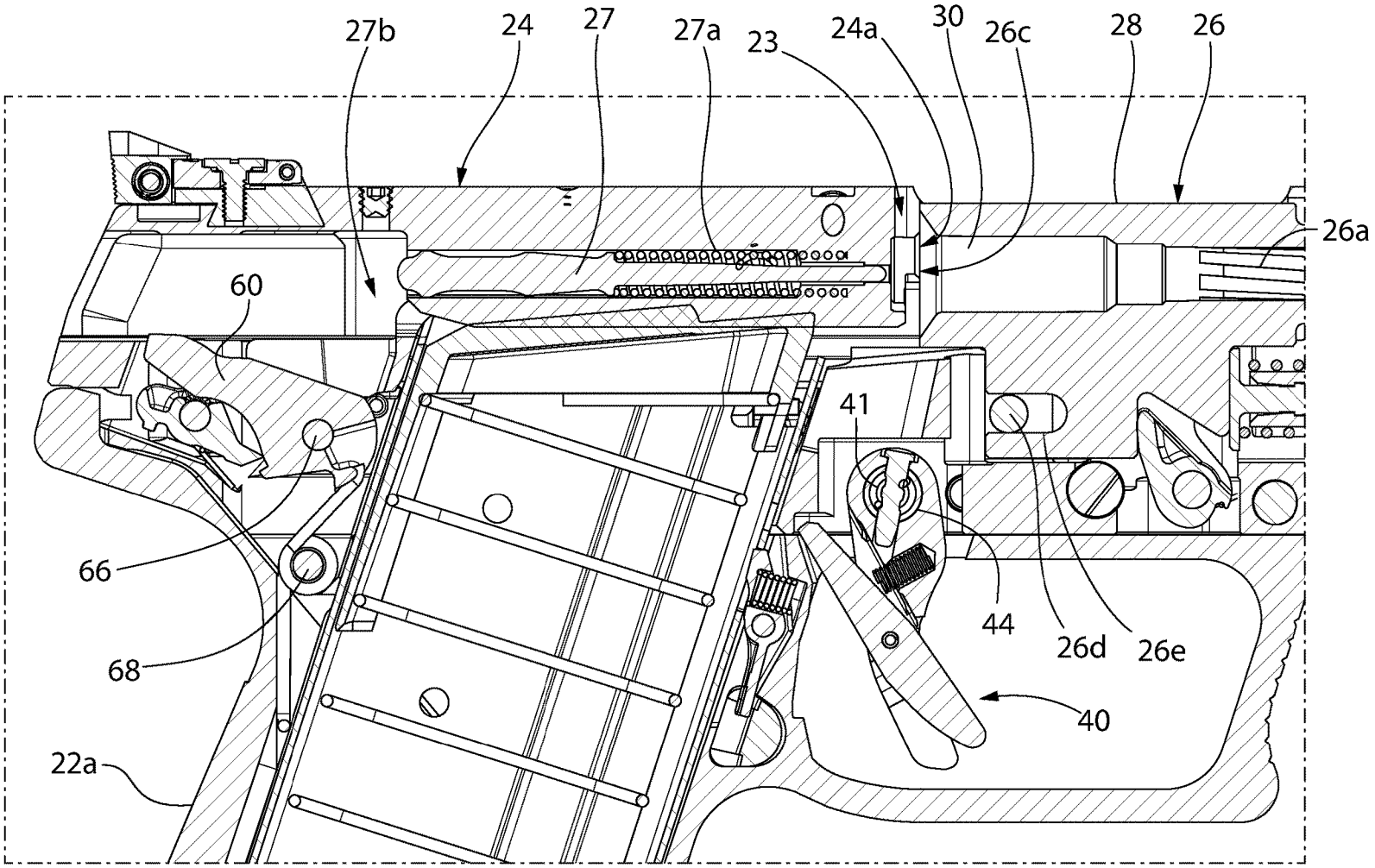
FIG. 7B is an enlarged detail from FIG. 7A.
Figure 8:
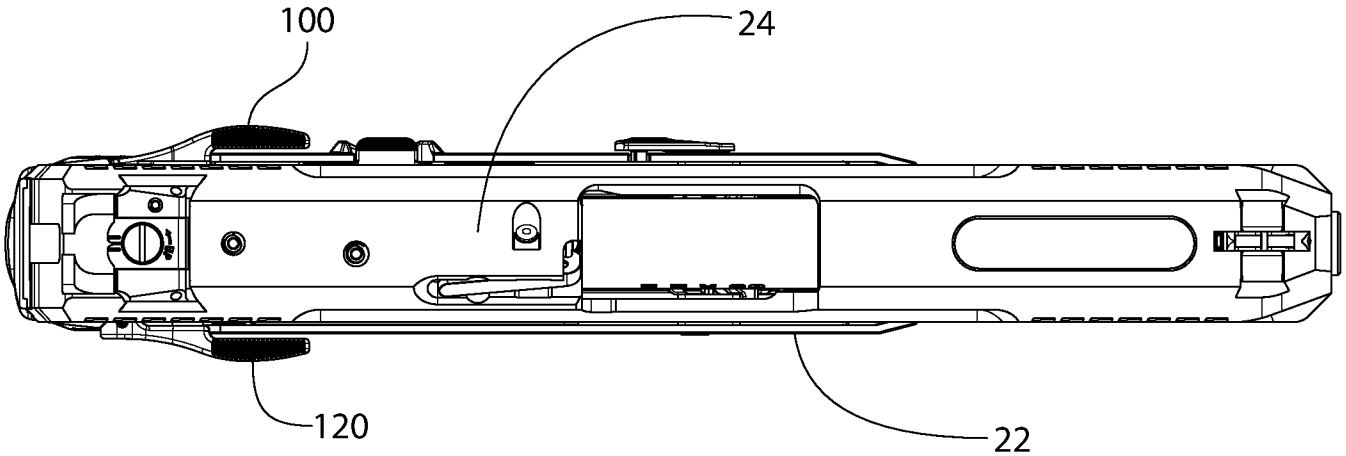
FIG. 8 is a top view of the firearm of FIG. 1.
Figure 9:
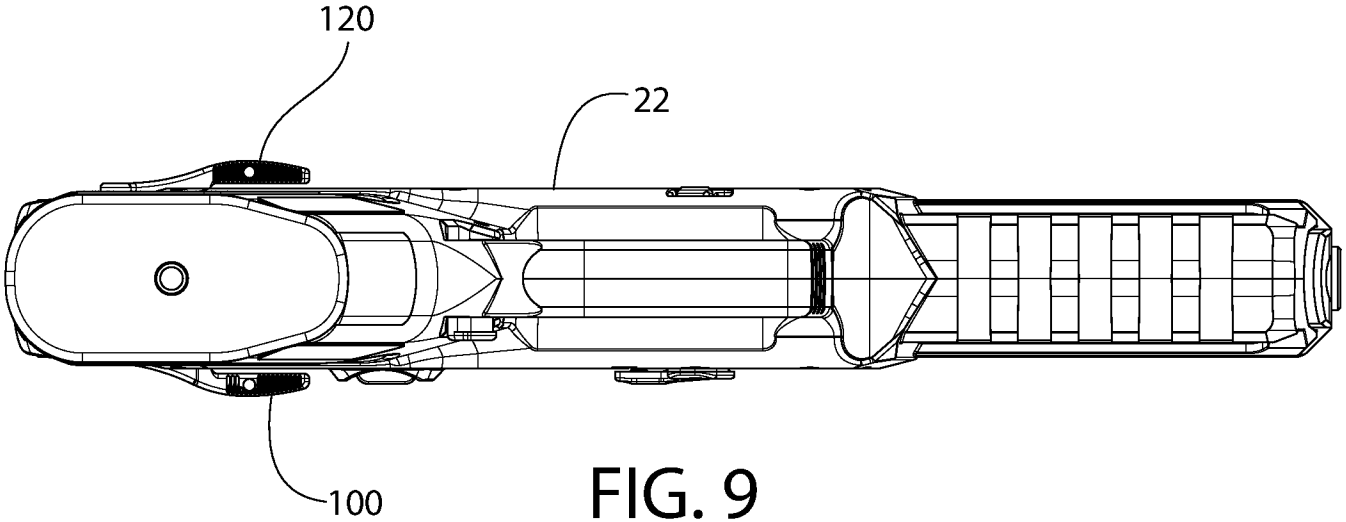
FIG. 9 is a bottom view of the firearm of FIG. 1.

A trigger return spring 44 may further be provided which in one embodiment may be a torsion spring that is mounted to trigger pin 41 and biases trigger 40 toward the fully forward ready-to-fire position (see, e.g. FIGS. 5 and 7B). Trigger spring 44 may further include a rearwardly extending leg 44*a* (see, e.g. FIG. 13) configured to act on the underside of trigger bar 42 to bias the rear working end of the trigger bar upwards towards engagement with sear 70, as further described herein. In other embodiments, separate springs may be used to bias the trigger bar upwards.

Figure 22:
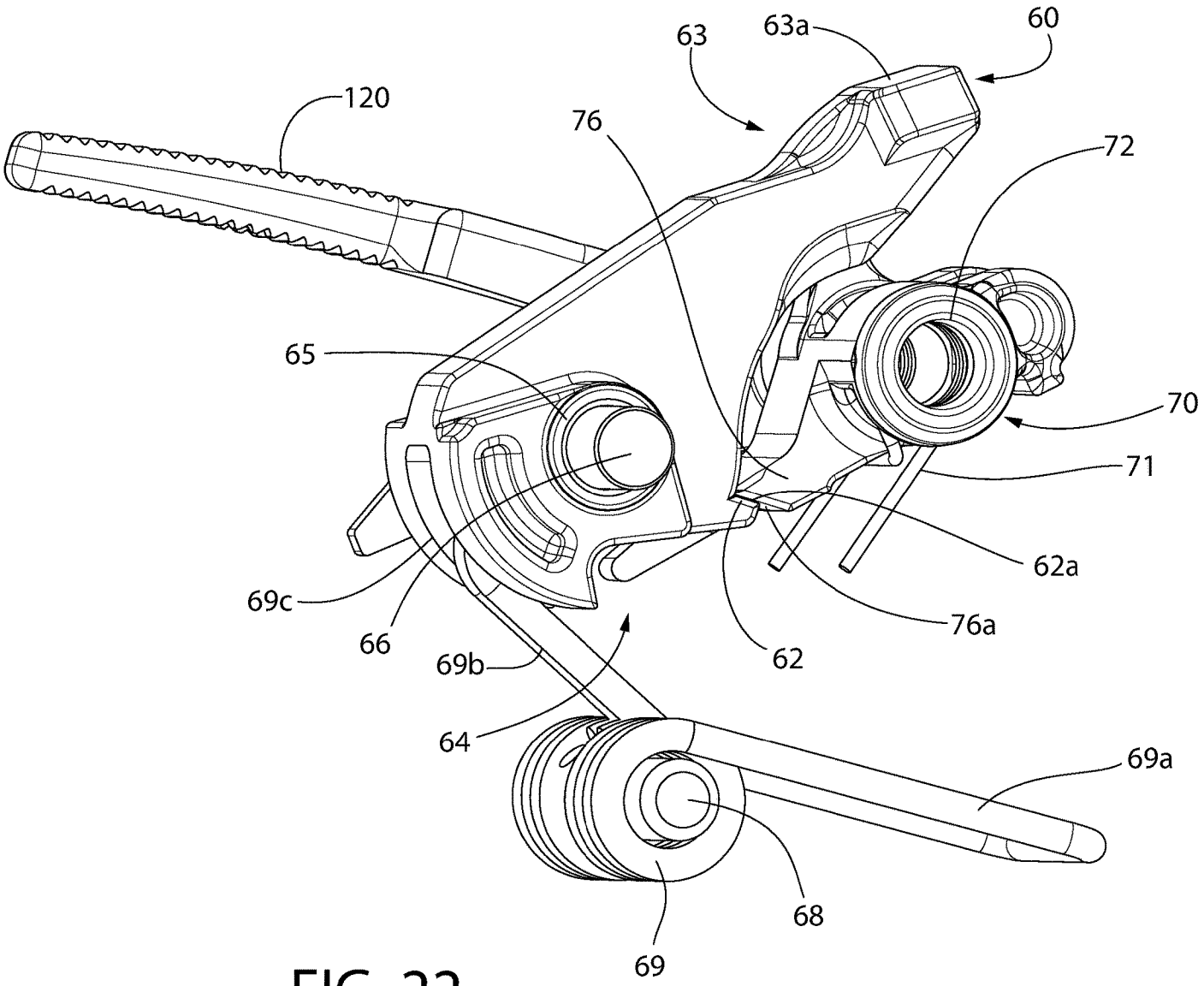
FIG. 22 is an enlarged left perspective view thereof showing engagement between the sear and a striking member in the form of a pivotable hammer.
Figure 23:
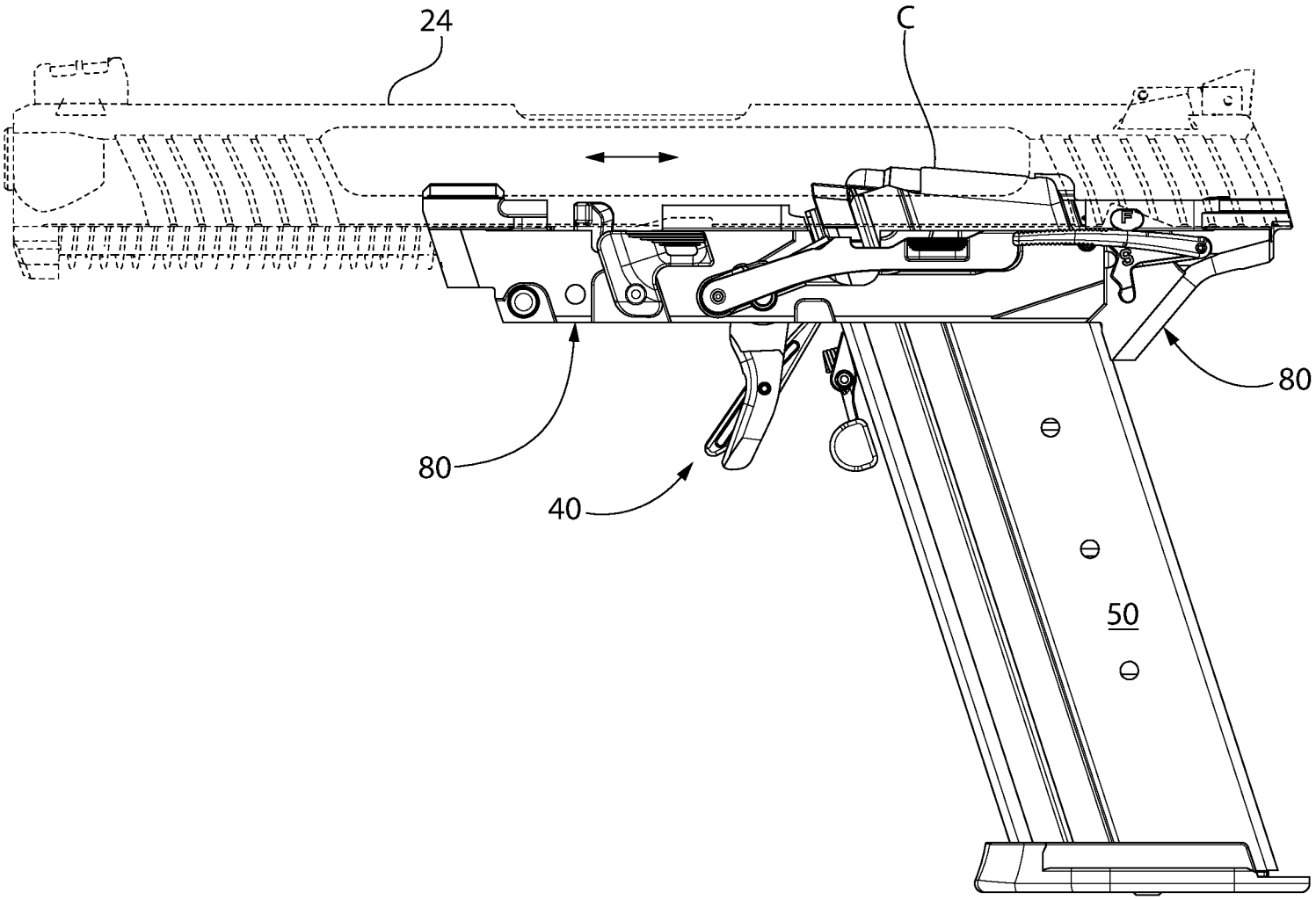
FIG. 23 is a left side view of the firearm showing the firing control insert which houses the firing mechanism components.
Figure 31:
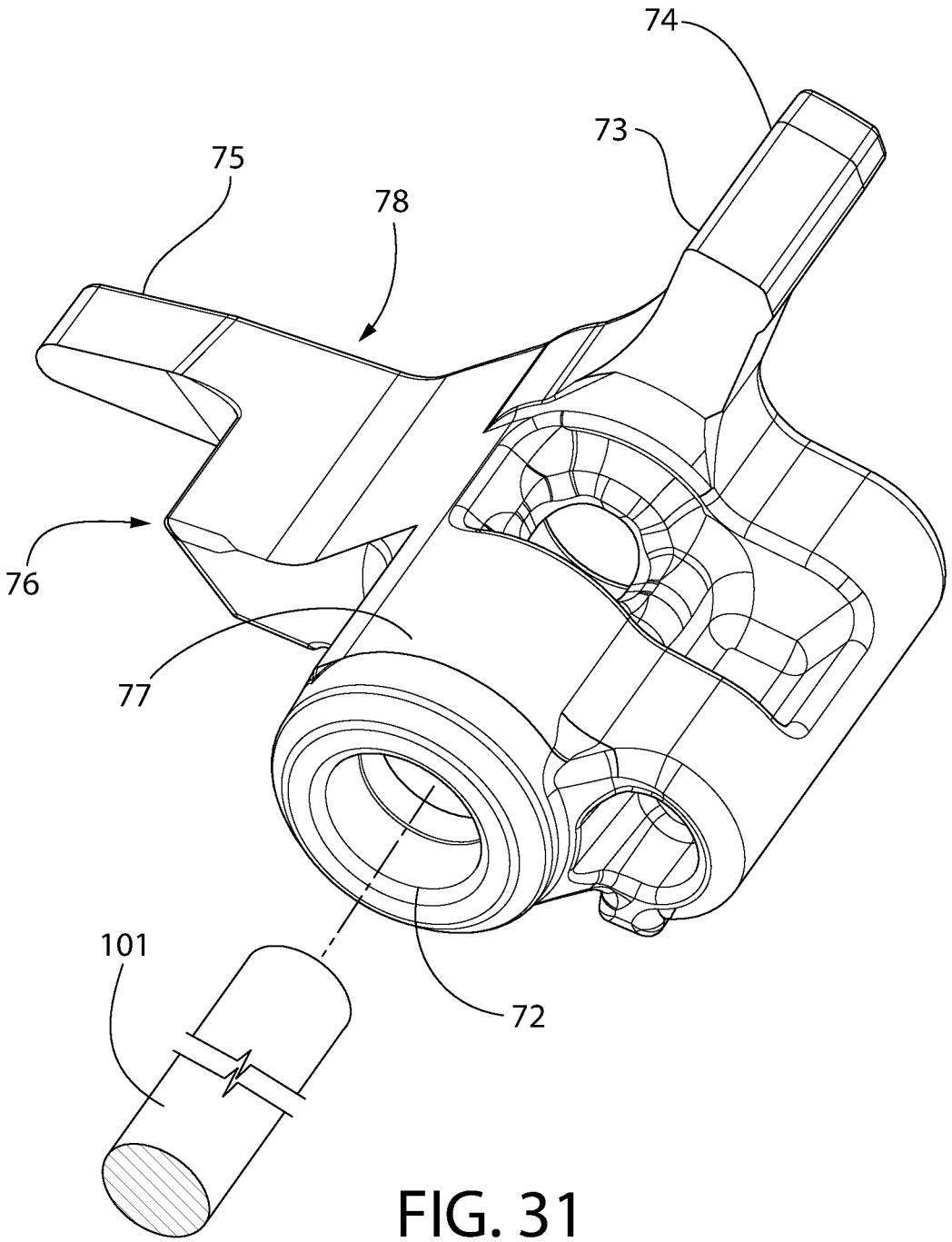
FIG. 31 is a first perspective view of the sear of the firing mechanism.
Figure 32:
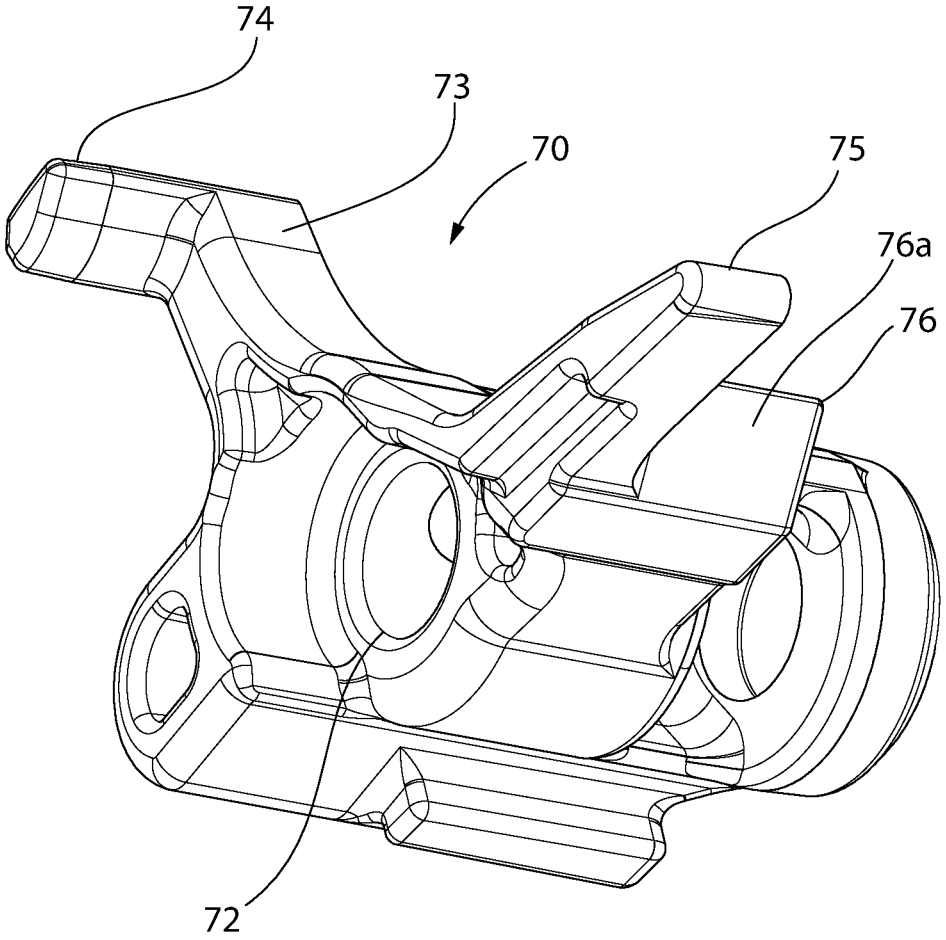
FIG. 32 is a second perspective view thereof.

The firing control system or mechanism further includes hammer 60 for striking the firing pin 27 and sear 70 operably coupled to and cooperating with the hammer to fire the firearm via a trigger pull. The sear acts in a conventional manner to engage and retain the hammer 60 in a rearward pivoted cocked position until the trigger is pulled, and then disengages and releases the hammer via a trigger pull to strike firing pin 27 and discharge the firearm. FIG. 22 shows the interface and engagement surfaces between the sear and hammer which achieves this operation. FIGS. 31 and 32 show the sear in isolation and greater detail.

Figure 28:
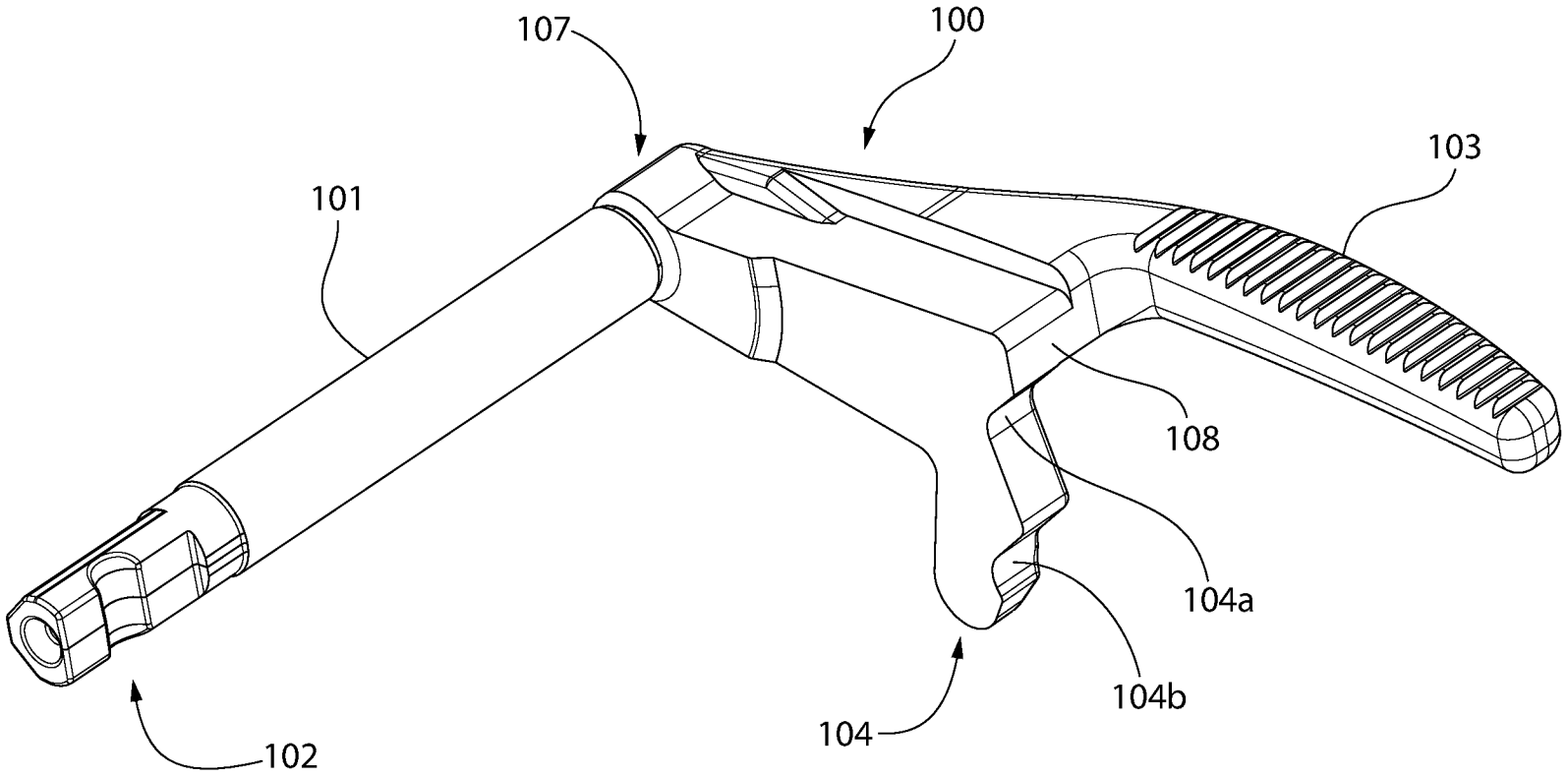
FIG. 28 is a second perspective view thereof.
Figure 29:
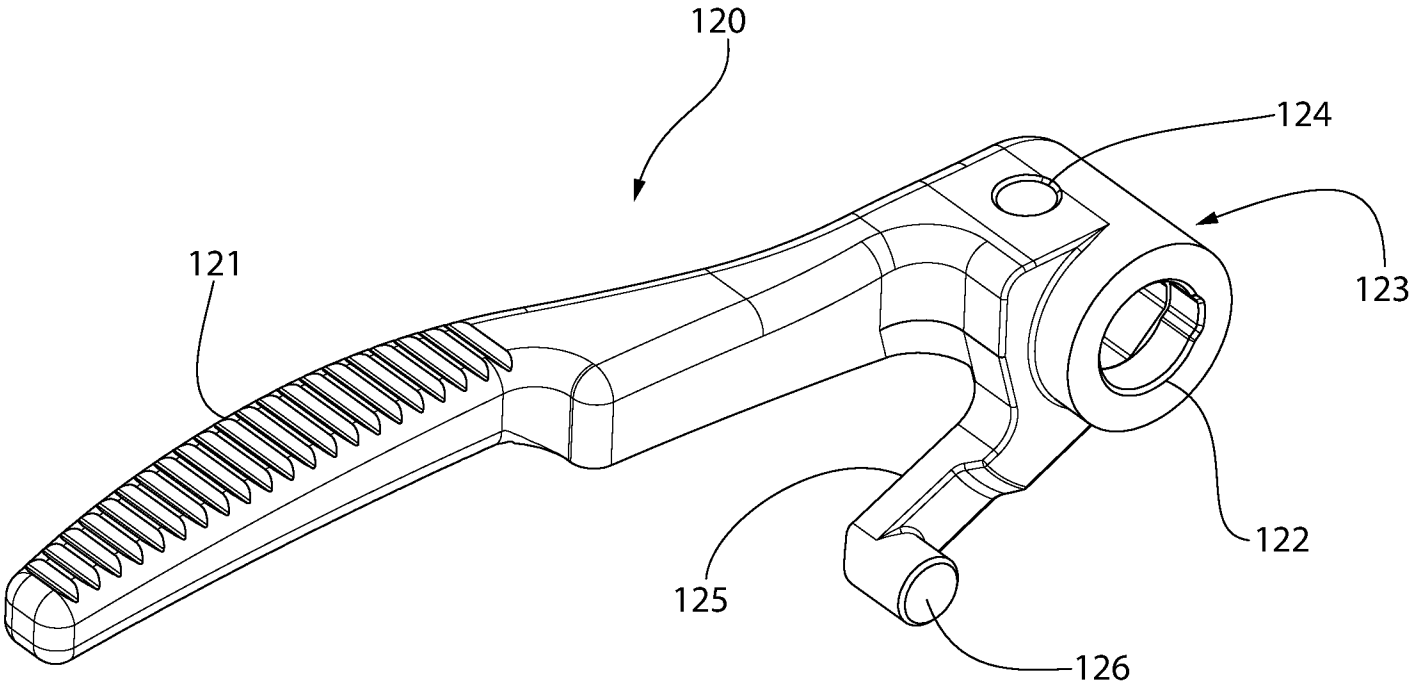
FIG. 29 is a first perspective view of the right actuator lever of the safety mechanism.
Figure 30:
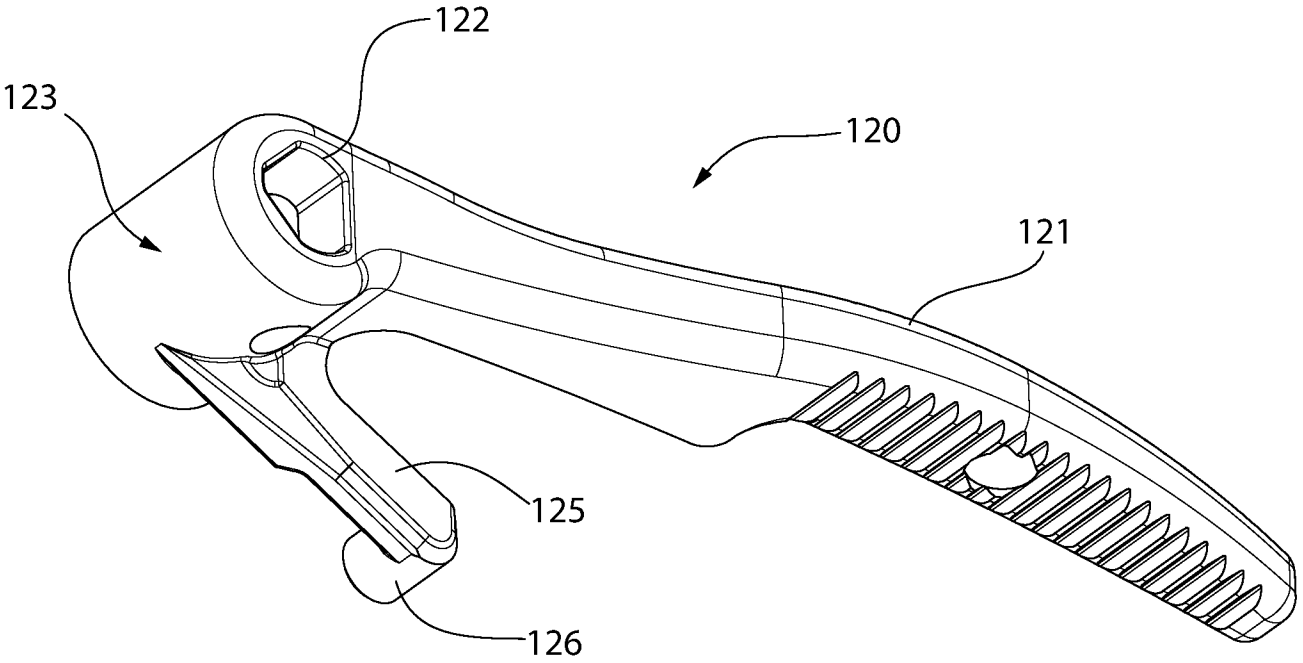
FIG. 30 is a second perspective view thereof.

Referring now to FIGS. 1-22 and 31-32, sear 70 is pivotably mounted to fire control insert 80 to the rear of hammer 60 via a transverse sear pivot, which in one embodiment as shown may be formed by the cylindrical coupling rod 101 of the safety left actuator lever 100 (see also FIG. 28). This efficiently obviates the need for a separate sear pin and saves space and manufacturing costs. In other embodiments, however, a separate sear pin may be provided if desired. The safety lever coupling rod 101 is received through transversely open sear pin hole 72 formed through the body of the sear. Coupling rod 101 defines a transverse pivot axis.

Sear 70 has a body including a main barrel portion 77 which defines cylindrical sear pin hole 72 extending transversely therethrough to receive safety left actuator lever coupling rod 101 therethrough, a vertically elongated operating extension arm 73 projecting upwards from the barrel portion, and a forwardly extending hammer engagement portion 78. Engagement portion 78 includes a primary and secondary hammer catch. The primary hammer catch comprises a wedge-shaped primary sear catch protrusion 76 configured to engage and retain hammer 60 in the rearward cocked position. The secondary hammer catch comprises an axially/horizontally elongated secondary sear catch arm 75 extending forwardly from the engagement portion and also configured to engage and retain hammer 60 in the rearward cocked position in the event the primary sear catch protrusion disengages accidently from the sear without the trigger being pulled. Secondary sear catch arm 75 projects forward beyond sear catch protrusion 76 and engages a laterally open secondary hammer notch 61 formed on hammer 60 (see, e.g. FIG. 12). The secondary sear catch arm 75 provides an added layer of security designed to avoid unintentional firing of the firearm.

The primary sear catch protrusion 76 defines a laterally broadened and elongated catch surface 76A which is selectively engageable with primary hammer notch 62 formed on the lower rear portion of hammer 60 (see, e.g. FIG. 22) for retaining the hammer in the rearward cocked position. Hammer notch 62 may be rearward facing and defines an upward facing notch surface 62*a* which engages the downward facing sear catch surface 76*a* on sear 70 via a substantially flat-to-flat interface as shown.

Sear 70 is biased in an upwards or upright direction and orientation towards engagement with the hammer by sear spring 71 (clockwise as viewed in FIG. 22). Accordingly, spring 71 biases sear catch protrusion 76 towards engagement with hammer notch 62. In one embodiment, sear spring 104 may be a torsion spring having the coiled portion wound around left safety lever coupling rod 101. A downward extending leg 104*a* of spring 104 may be braced against a portion of the frame 22 and/or firing control insert 80.

Hammer 60 includes an elongated upper striking portion 63 defining a substantially flat front facing striking surface 63*a* for striking the rear end of firing pin 27 to discharge the firearm, and lower operating portion 64 which defines the hammer notch 62 and notch surface 62*a* previously described herein. The lower operating portion further includes a transverse through pivot hole 65 which receives hammer pivot pin 66 is located approximately midway between the striking and operating portions in the central portion of the hammer body as shown. Hammer pivot pin 66 extends laterally and transversely to longitudinal axis LA through the fire control insert 80 and defines a corresponding transverse pivot axis of the hammer. The hammer pivot pin 66 and the sear pivot defined by safety left actuator lever coupling rod 101 are each oriented parallel to each other and perpendicularly transverse to the longitudinal axis. Hammer spring 69 is mounted in firing control insert 80 to a separate hammer spring pin 68 and biases the striking portion 63 of hammer 60 forward toward the firing pin 27. Spring 69 may be an elongated coil spring housed in firing control insert 80 including a rear loop 69*a* braced against the firing control insert housing and an upwardly extending legs 69*b* engaged in frontal spring notch 69*c* of the hammer lower operating portion 64 (see, e.g. FIGS. 12 and 22). Other types and arrangements of springs may be used to bias the hammer towards the forward firing position. Hammer 60 is movable between the forward firing position striking the firing pin 27 and the ready-to-fire rearward cocked position via the trigger bar 42 and sear 70 which mechanically couple the trigger 40 to hammer.

Figure 33:
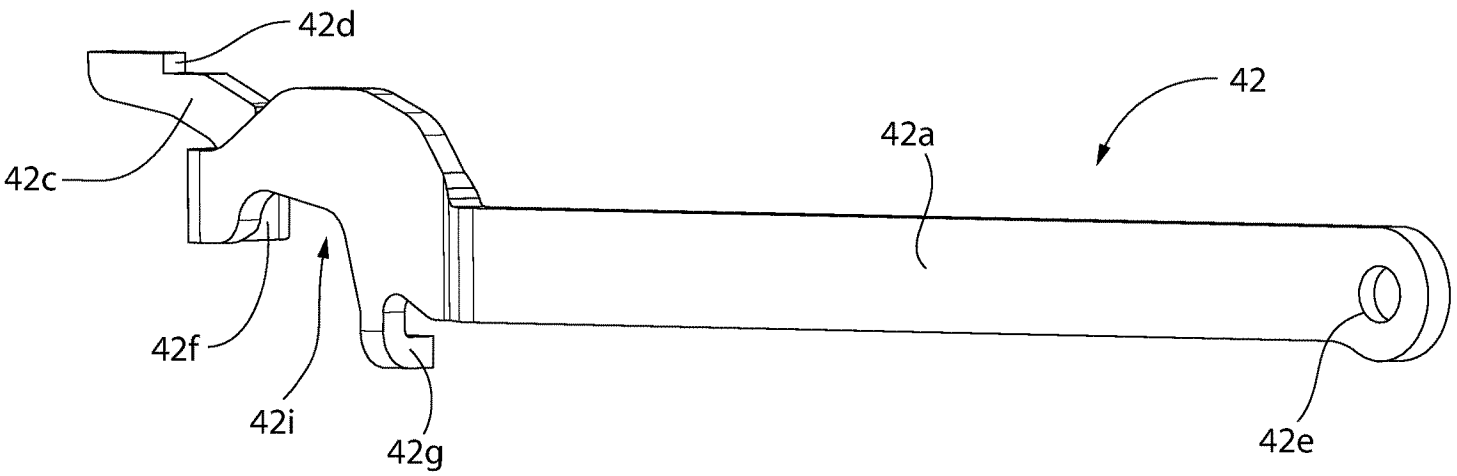
FIG. 33 is right side perspective view of the trigger bar of the firing mechanism.
Figure 34:
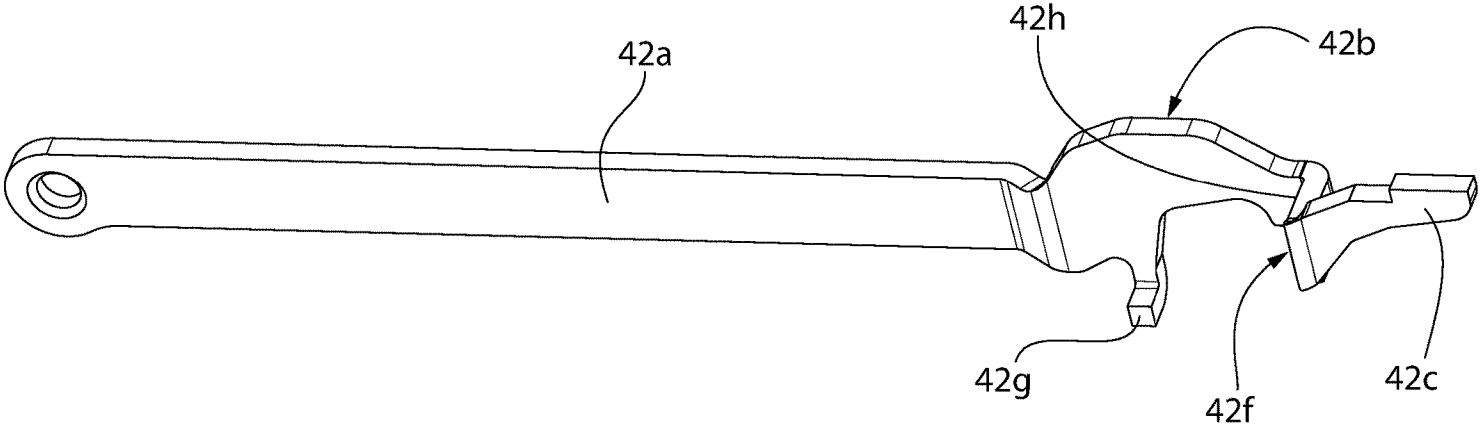
FIG. 34 is a left side perspective view thereof.
Figure 35:
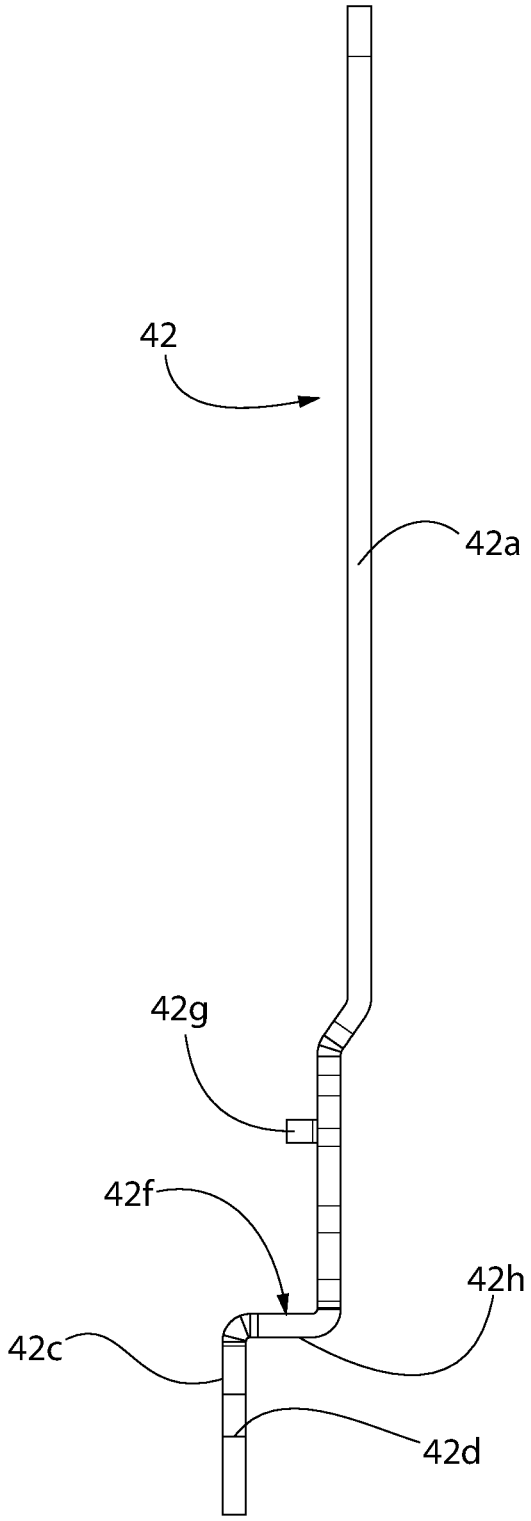
FIG. 35 is a top view thereof.

Operating extension arm 73 of sear 70 extending vertically upwards from the sear body comprises a laterally/transversely extending actuation protrusion 74 at its end. The sear actuation protrusion 74 is oriented perpendicularly to the length of the extension arm and longitudinal axis LA of the firearm. Sear actuation protrusion 74 is selectively engageable with a corresponding forward facing trigger bar operating surface 42*d* formed on the rear end of trigger bar 42 for rotating the sear 70 via a trigger pull to release the hammer 60 and discharge the firearm 20. FIGS. 10-13 show trigger bar operating surface 42*d* axially aligned to engage sear actuation protrusion 74 when the trigger is pulled with the safety mechanism in the "fire" position. Operating surface 42*d* of trigger bar 42 may be defined by a rearwardly and upwardly extending trigger bar operating protrusion 42*c* formed on the rear working end portion 42*b* of the trigger bar, as best shown in FIGS. 33-35. In one embodiment, trigger bar operating protrusion 42*c* may be configured as a generally elongated flattened plate-like body which is both laterally and inwardly offset from the elongated linear forward portion 42*a* of the trigger bar by a blocking portion 42*h* extending laterally inwards from rear working end portion 42*b*.

Referring to FIGS. 33-36, trigger bar 42 may have a generally flat and relatively thin plate-like structure overall having an axially elongated configuration (i.e. along the direction of longitudinal axis LA). The body may be monolithic in structure and formed of metal bent to shape to form the various operating appurtenances and features described herein. Trigger bar 42 extends along longitudinal axis LA from trigger 40 to the sear 70. The trigger bar 42 may be located on the right lateral side of the firearm between the outer frame 22 and inner fire control insert 80 (see, e.g. FIG. 24). Trigger bar 42 however may be movably supported by and part of the firing control insert 80 components. The front end portion comprises a pin hole 42*e* which is pinned to the trigger 40 as previously described herein.

Rear working end portion 42*b* includes a downwardly open concavity 42*i* into which hammer pivot pin 66 protrudes to avoid interference with operation of the trigger bar. The blocking portion 42*h* which extends laterally inwards from rear working end portion 42*b* defines a forward facing blocking surface 42*f* configured to be selectively engaged by the safety rocker 140 when the safety mechanism is in the "safe" position. The safety rocker 140 further is operable to engage an inwardly projecting disconnect hook protrusion 42*g* formed on the bottom of the working end portion 42*b*. The disconnect hook protrusion allow the safety mechanism to disconnect or uncouple the trigger bar from the sear 70 such that a trigger pull cannot actuate the sear to discharge the firearm when the safety is in the "safe" position, as further described herein.

Further aspects of the safety mechanism will now be described. Referring initially in general to FIGS. 1-36, the ambidextrous dual-acting safety mechanism comprises left actuator lever 100, right actuator lever 120, and safety rocker 140. The left and right actuator levers are operably coupled together such that moving one concomitantly moves the other, as further described herein.

FIGS. 27-30 show the left and right actuator levers in isolation and detail. Left actuator lever 120 has a body including an axially elongated and cantilevered operating handle 103, detent lobe 104 depending downwardly therefrom, and cylindrical coupling rod 101 extending perpendicularly from the handle. The lever body may have a monolithic unitary structure in one embodiment. Handle 103 may have a textured surface to facilitate engagement by the user to change the condition or position of the safety mechanism between a "fire" position and a "safe" position. Coupling rod 101 has a generally cylindrical body and extends from the left side of the firearm frame 22 to the right side through the firing control insert 80 (left and right designations given from the viewpoint of the user looking forward from the rear of the firearm as held in the usual firing position downfield). The coupling rod 101 is rotatably coupled to firing control insert and frame. The coupling rod 101 may be located at the rear end portion 107 of the handle 103 in one embodiment to maximize the arc through which the lever 100 may be rotated. One end of rod 101 is fixedly coupled to handle 103, while the opposite end defines a terminal coupling end 102 configured to lockingly engage coupling socket 122 formed at the rear of the right actuator lever 120. Coupling rod 101 may be pinned to the right actuator lever via mounting pin 113 (see, e.g. FIG. 13).

Detent lobe 104 of left actuator lever 100 is a vertically elongated protrusion including concave upper and lower detent surfaces 104*a*, 104*b*. The detent surfaces are vertically spaced apart and selectively engaged by a spring-biased detent plunger 105 acting in an axial direction. In one non-limiting arrangement, the detent surfaces 104*a*, 104*b* may face forward and the plunger is biased rearward towards the surface by detent spring 106 (see, e.g. FIG. 11). The opposite arrangement may be used in other possible embodiments. The detent plunger and spring may be mounted to the frame 22 and/or firing control insert 80. The detent surfaces and plunger act to maintain the safety mechanism in either of the "safe" or "fire" positions selected by the user.

Right actuator lever 120 has a body including an axially elongated and cantilevered operating handle 121, transversely open coupling socket 122 formed at a rear end portion 123 thereof, and an operating protrusion in the form of an operating extension arm 125 extending downwardly and forwardly from the rear end of the handle as shown. The rear end portion 123 which defines the coupling socket may be generally barrel shaped as shown and includes a pin hole 105 which receives the mounting pin 113 to lockingly coupled the coupling rod 101 from the left actuator lever 100 in place. The coupling end 102 of coupling rod 101 and socket 122 may have complementary configured non-circular profiles as shown to ensure non-rotational coupling between them in addition to the pinning. The right lever body may also have a monolithic unitary structure in one embodiment similarly to the left lever body. Handle 121 may have a textured surface to facilitate engagement by the user to change the condition or position of the safety mechanism between the "fire" and "safe" positions.

The operating extension arm 125 is longitudinally elongated in structure and oriented in the axial direction along the longitudinal axis LA of the firearm. Operating extension arm 125 projects forwardly and downwardly from the rear end portion 123 of right actuator lever 120. In one embodiment, extension arm protrusion 125 includes an operating pin 126 formed integrally with the protrusion. Pin 126 may be cylindrical and projects transversely/laterally outwards to engage an actuation recess 143 of safety rocker 140.

Figure 10:
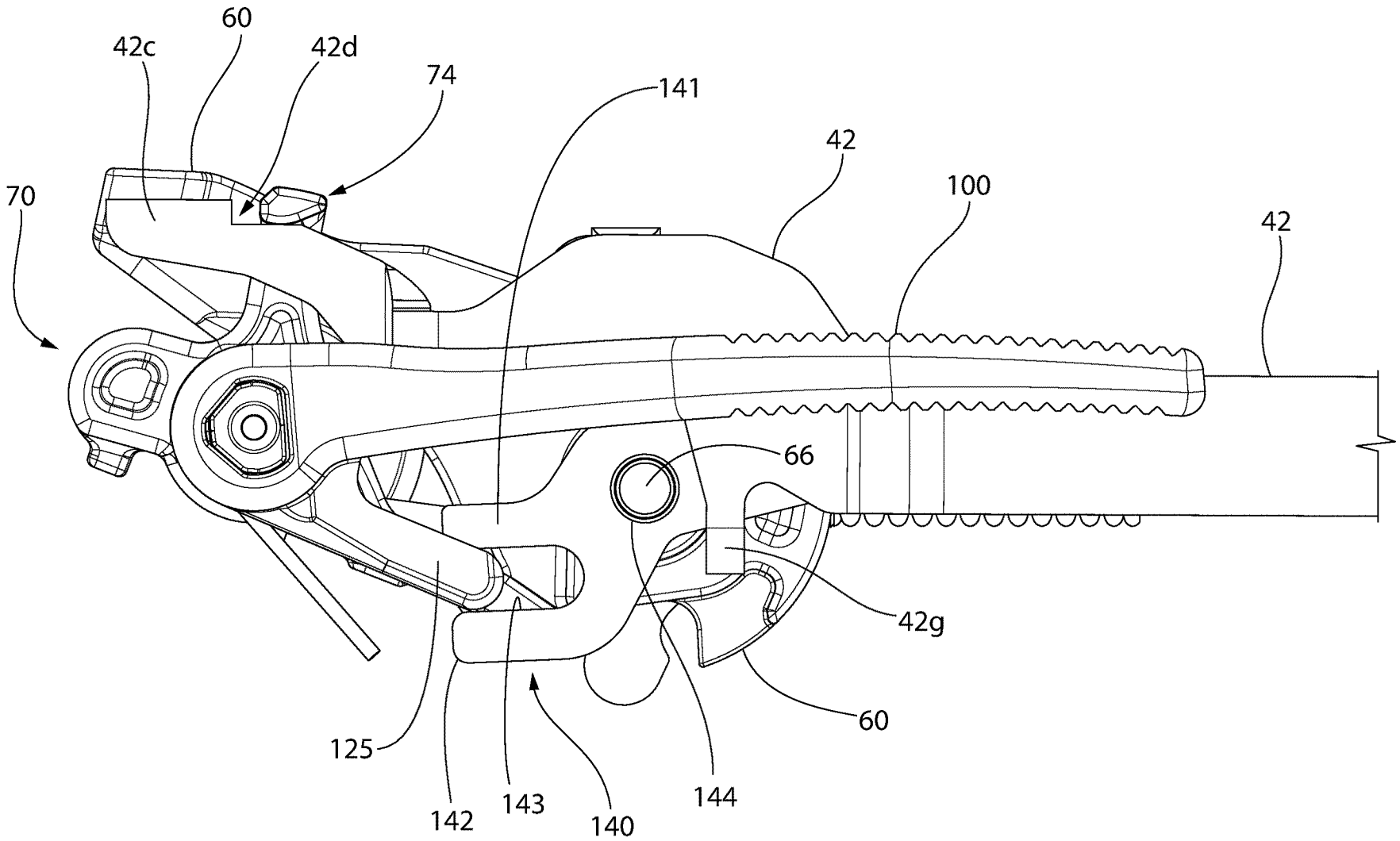
FIG. 10 is a right side view of the safety mechanism in a "fire" position.
Figure 11:
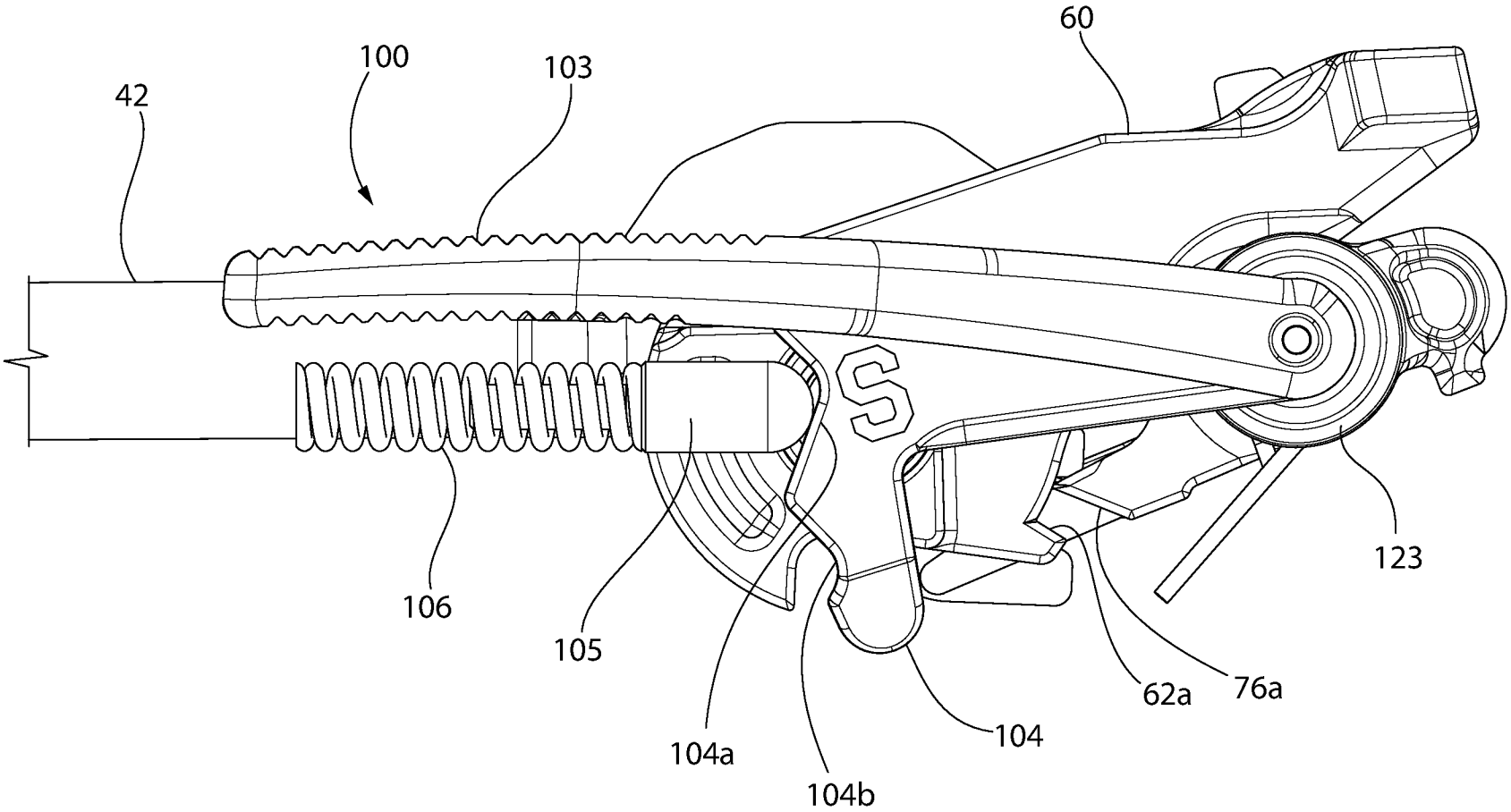
FIG. 11 is a left side view thereof.
Figure 12:
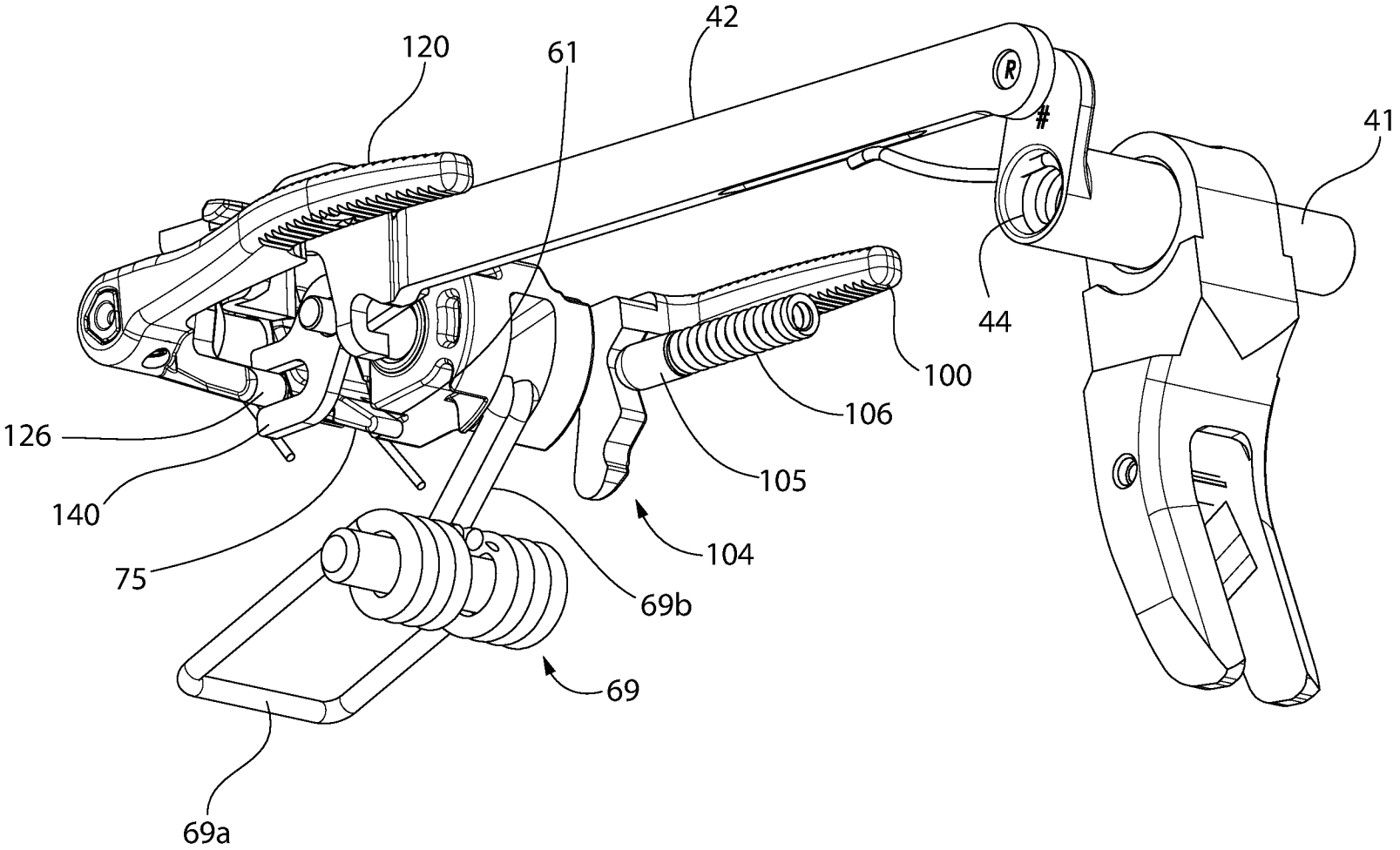
FIG. 12 is a right bottom perspective view thereof.
Figure 19A:
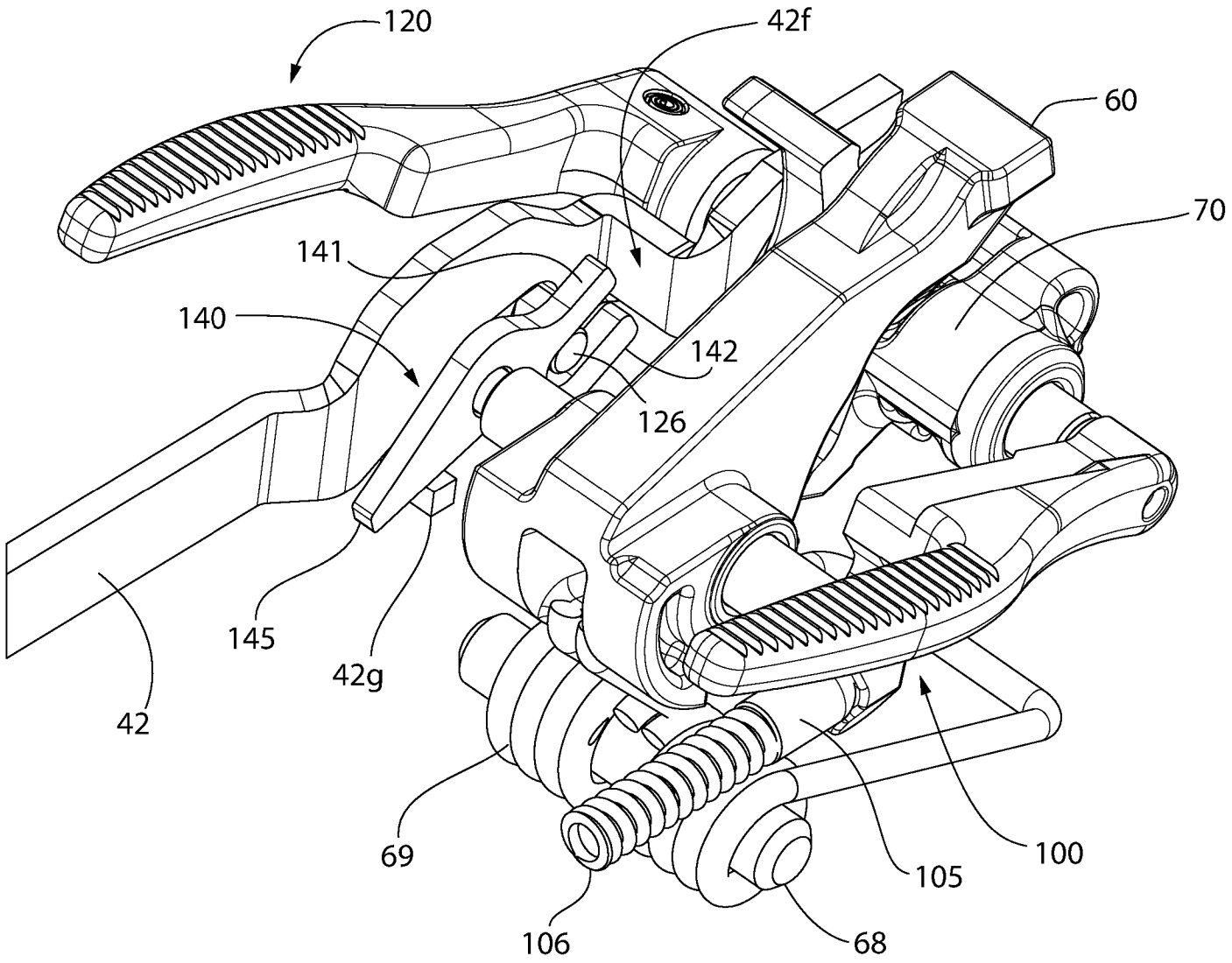
FIG. 19A is an enlarged top left perspective view thereof.
Figure 19B:
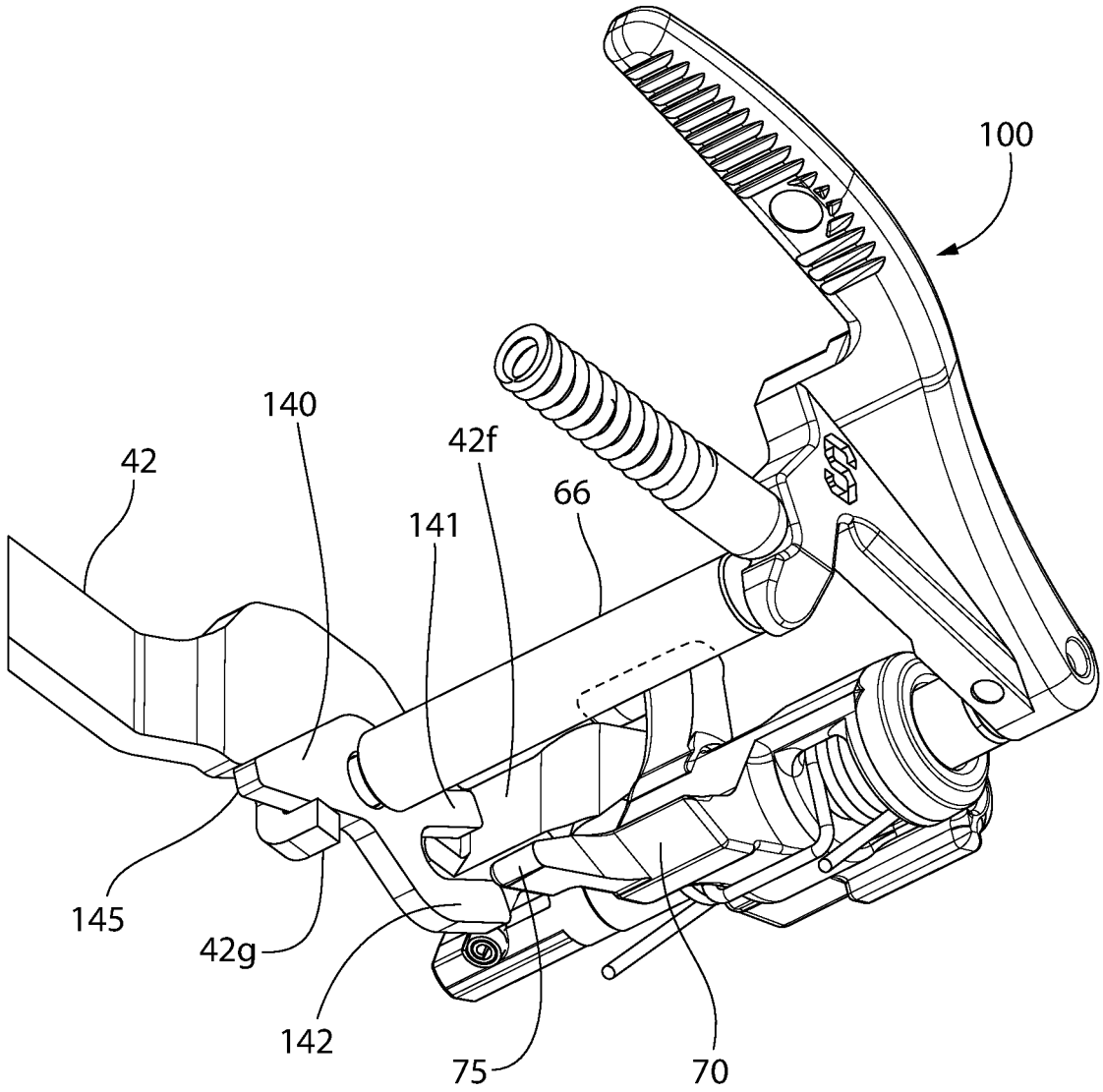
FIG. 19B is an enlarged bottom left perspective view thereof.
Figure 20:
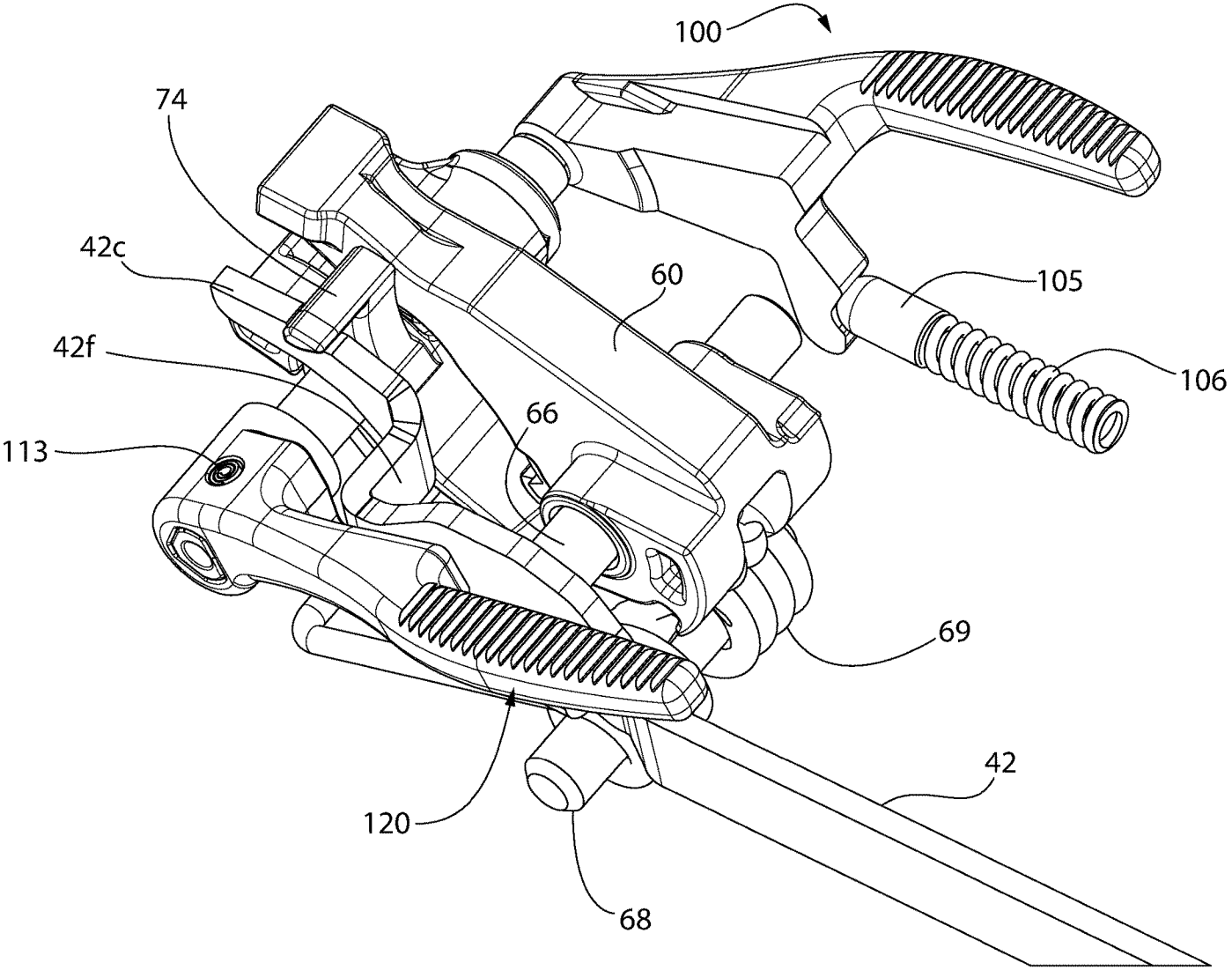
FIG. 20 is a first enlarged top right perspective view thereof.
Figure 21:
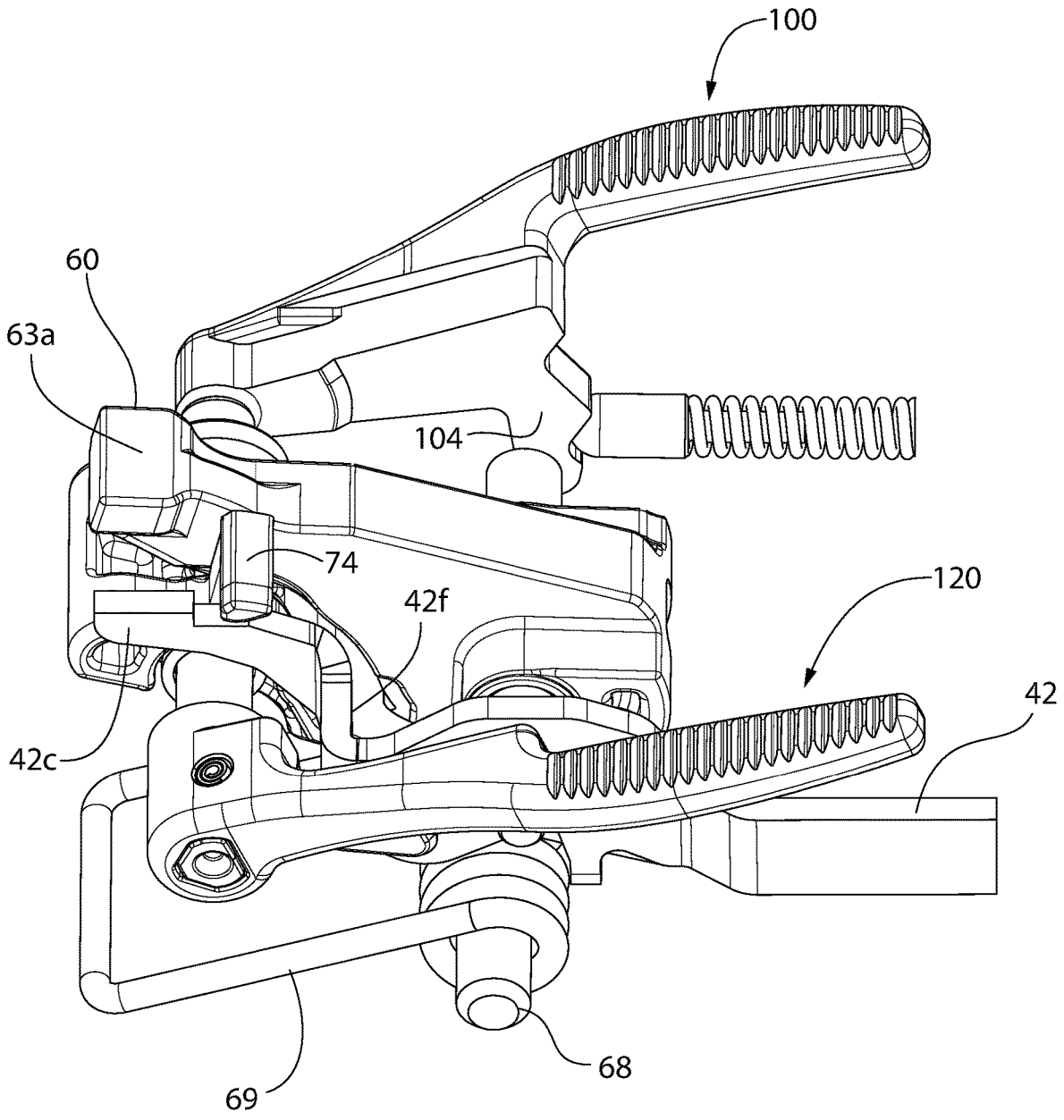
FIG. 21 is a second enlarged top right perspective view thereof.

Referring to FIGS. 10 and 19A-B, safety rocker 140 in one embodiment has a generally flattened plate-like and longitudinally elongated body comprising a bifurcated rear end including rearwardly projecting upper and lower actuation prongs 141, 142 which define a rearwardly open actuation slot or recess 143. Recess 143 receives transversely oriented operating pin 126 of the right actuator lever extension arm 125. Moving the right actuator lever 120 upward and downwards in motions associated with the safe and fire positions of the safety mechanism causes the safety rocker in turn to rotate in an alternating toggle-action upward and downward. The upper actuation prong 141 is engageable with the forward facing blocking surface 42*f* of trigger bar 42 to block movement thereof when the safety mechanism is in the safe position and the upper action prong is in the upward position.

Safety rocker 140 further comprises a forwardly projecting and longitudinally elongated operating protrusion 145 engaged with disconnect hook protrusion 42*g* on the trigger bar to lower and disengage the trigger bar from the sear via rotating the safety rocker. Protrusion 145 may be considered nose shaped in one embodiment with a rounded front end; however, other configurations which function similarly may be provided. Safety rocker 140 includes a transversely oriented pivot hole 144 which receives the right end of hammer pin 66 to pivotably mount the safety rocker to the firearm. In other possible embodiments, a separate safety rocker pivot pin may be provided. Pivot hole 144 is located about midway between the front and rear ends of the safety rocker as shown. The safety rocker is thus configured such that upward rotation of its rear end (e.g. actuation prongs 141, 142) rotates the operating protrusion 145 at front in an opposite downward direction to displace and force the trigger bar 42 downward, thereby disengaging the sear 70 from the trigger bar.

Figure 25:
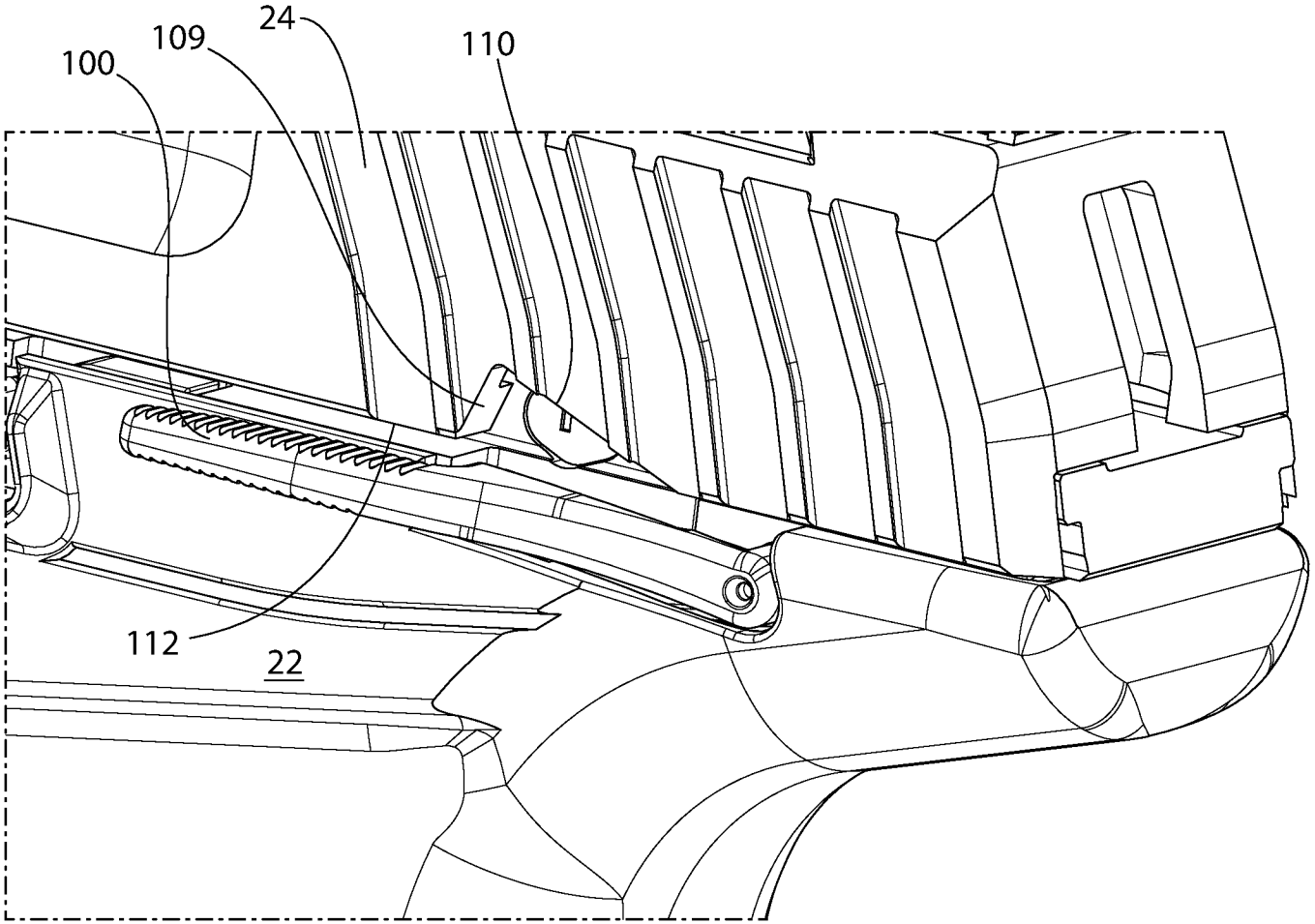
FIG. 25 is a left perspective view showing a slide locking feature of the safety mechanism in a first unlocked position.
Figure 26:
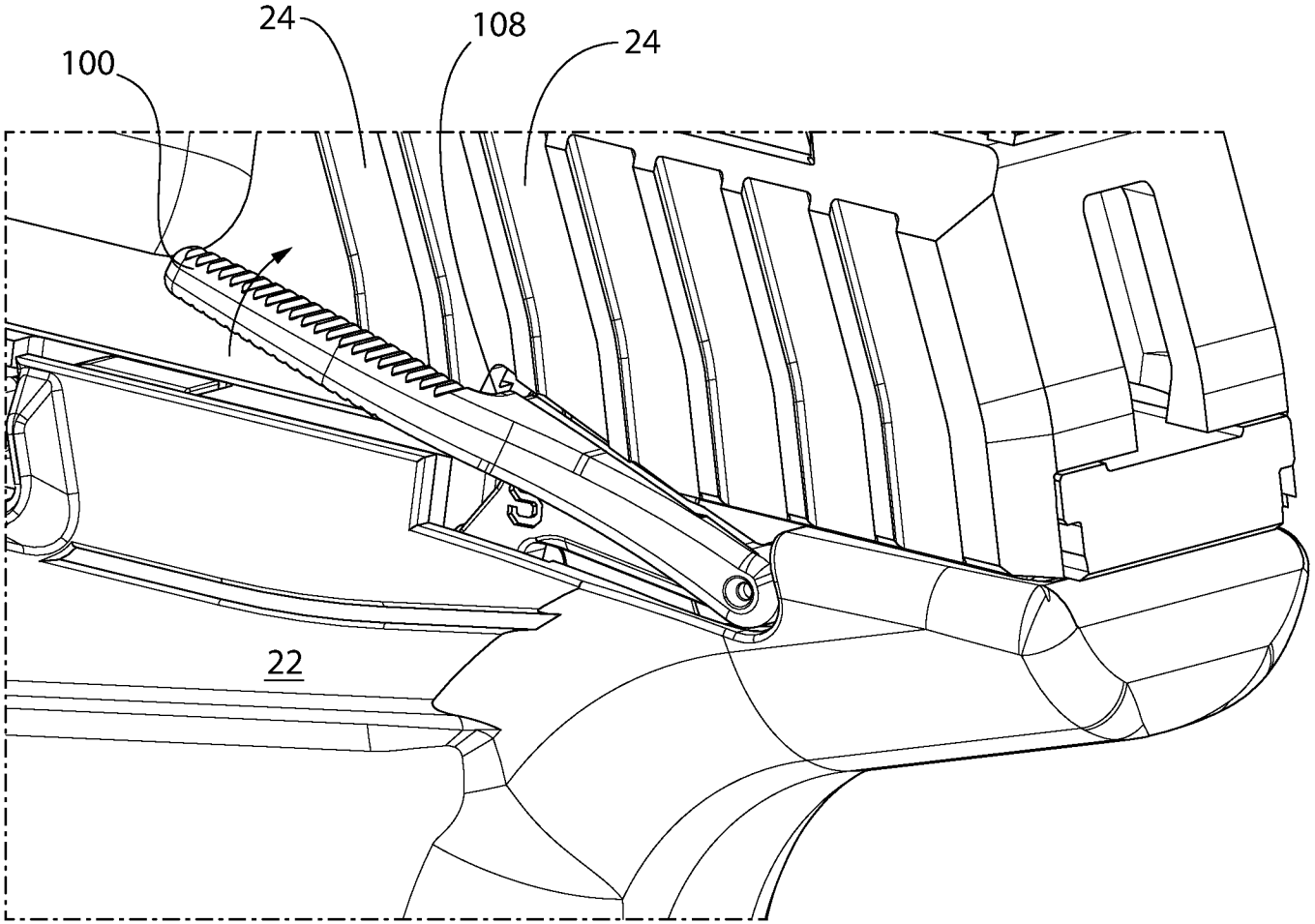
FIG. 26 is a left perspective view thereof showing the slide locking feature in a locked position.
Figure 27:
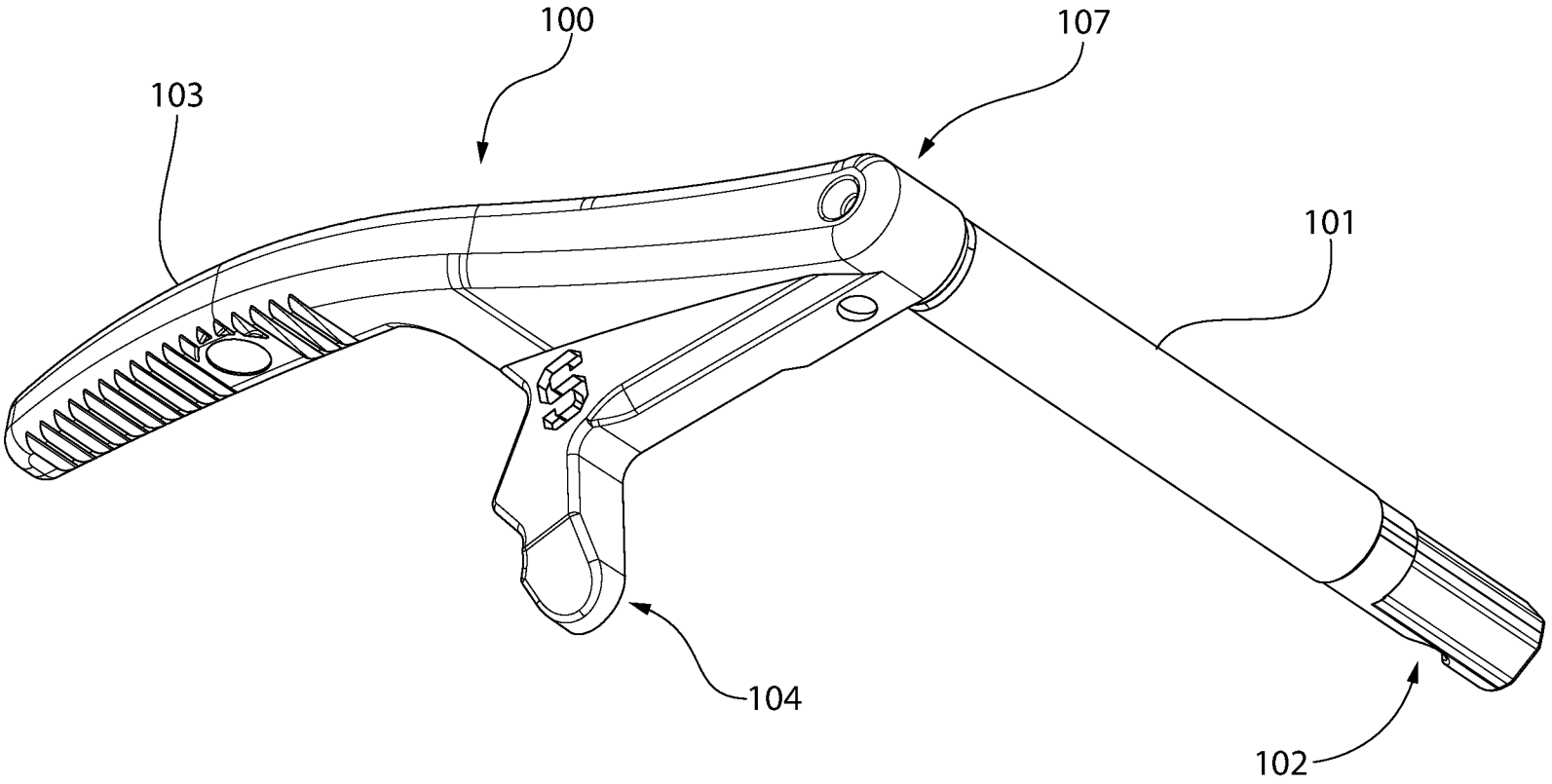
FIG. 27 is a first perspective view of the left actuator lever of the safety mechanism.

According to another aspect, the safety mechanism may be further operable to lock the slide in the forward closed breech position. Referring to FIGS. 25-28, left actuator lever 100 of the safety mechanism comprises a forward facing locking surface 108 which is selectively engageable with a corresponding locking surface 109 formed on the left bottom longitudinal edge 112 of slide 24. In one embodiment, the slide locking surface 109 may be located in a downwardly open V-notch formed on the slide edge 112. Locking surface 108 of lever 120 may be formed inwards from handle 103 near the base of the handle as shown and directly above the detent lobe 104 in one embodiment. FIG. 25 shows the safety in the fire position with the operating handle 103 rotated into the downward position. The mating locking surfaces are not engaged thereby allowing the slide to be retracted and the breech opened either manually by the user or automatically upon discharging the firearm. When the handle 103 is raised to activate the safety mechanism ("safe" position) as shown in FIG. 26 with a closed breech, locking surfaces 108, 109 become mutually engaged to prevent retraction of the slide.

A method for operating the present ambidextrous dual-action safety mechanism will now be briefly described. It bears reminding that moving either the left or right operating handle 103 or 121 of the ambidextrous safety actuates and changes the position/state of the safety mechanism.

FIGS. 10-13 show the safety mechanism in the "fire" position. Both operating handles 103, 121 of the left and right actuator levers 100, 120 respectively are in a horizontal position generally parallel to longitudinal axis LA of the firearm. This may also be considered to be the downward operational position within the pivotable arcuate range of rotation of the handles. Trigger bar 42 is in its upper position in which the actuation protrusion 74 on the upright operating extension arm 73 of sear 70 is axially aligned and engageable with operating protrusion 42*c* formed on the rear working end portion 42*b* of the trigger bar. Trigger bar operating surface 42*d* at the terminus of protrusion 42*c* may be slightly ajar and spaced rearward from the sear actuation protrusion 74 in the "fire" position, but nonetheless is axially aligned to engage and actuate the sear when the trigger 40 is fully pulled to discharge the firearm. It bears noting that the upward biasing action of trigger spring 44 positively forces the trigger bar upwards and into engagement with the sear actuation protrusion 74 as shown, which acts as a travel stop limiting the uppermost position of the trigger bar 42.

With continuing reference to FIGS. 10-13, the operating extension arm 125 of right actuator lever 120 is downward and the safety rocker 140 is not activated. Accordingly, in the "fire" position of the safety mechanism, the sear 70 remains engaged with the trigger bar 42 and the forward motion of the trigger bar via a trigger pull necessary to rotate the sear to release the hammer and fire the firearm is not blocked. Pulling the trigger 40 rearward rotates the sear 70 forwards about its pivot axis to disengage and release the hammer forward to strike the firing pin 27, which in turn strikes and detonates a chambered cartridge C.

FIGS. 14-21 show the safety mechanism in the "safe position." To activate the safety, either of the operating handles 103, 121 of the left and right actuator levers 100, 120 respectively may be raised to its upper operational position (which concomitantly moves the other handle similarly upward). Both handles 103, 121 are obliquely oriented to longitudinal axis LA of the firearm as shown. Raising the operating handles concomitantly rotates and raises the operating extension arm 125 of the right actuator lever 120 about coupling rod 101, which in turn concomitantly rotates the safety rocker 140 (clockwise as viewed in FIG. 14). This creates two simultaneous actions and motions of the safety mechanism. First, operating protrusion 145 of safety rocker 140 engaged with trigger bar 42 forces the trigger bar to its lower and downward position. As shown, operating protrusion 42*c* of the trigger bar now disconnects from and disengages the upright actuation protrusion 74 of sear 70. Trigger bar operating surface 42*d* is no longer axially aligned with the sear actuation protrusion 74 such that pulling the trigger 40 which moves the trigger bar forward can no longer engage and rotate the sear to discharge the firearm due to this misalignment.

Simultaneously, the upper actuation prong 141 of safety rocker 140 rotates upwards to block and/or engage forward facing blocking surface 42*f* of the trigger bar. Accordingly, the forward motion of the trigger bar 42 necessary to discharge the firearm is also arrested by the blocking action of the safety rocker. If the user attempts to pull the trigger, the positive engagement between the trigger bar blocking surface and safety rocker will arrest the motion of the trigger indicating to the user that the safety mechanism is activated (i.e. in "safe" position).

It bears noting that the detent mechanism provided on the left side of the firearm by the detent surfaces 104*a*, 104*b* of the left actuator lever 100 and spring-biased detent plunger 105 will keep the safety in either the "fire" or "safe" positions selected by the user.

The safety mechanism may be returned the "fire" mode or position by reversing the foregoing steps.

While the foregoing description and drawings represent exemplary or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A firearm with dual-acting safety mechanism comprising:

a longitudinal axis;

a frame;

a striking member movably disposed in the frame, the striking member moveable between a rearward cocked position and a forward firing position;

a sear pivotably disposed in the frame, the sear configured to hold the striking member in the rearward cocked position;

a trigger mechanism comprising a trigger and trigger bar operably coupled to sear, the trigger bar movable to actuate the sear for releasing the striking member from the cocked position via a trigger pull to discharge the firearm;

a manually-operated safety mechanism comprising at least one manually movable first actuator lever pivotably mounted to the firearm and operably interfaced with the trigger bar, and a pivotably movable safety rocker operably coupled with the first actuator lever, the safety rocker engageable with the trigger bar and actuatable via moving the first actuator lever;

wherein the safety mechanism is changeable via moving the first actuator lever between: (1) a fire position in which the sear engages the trigger bar to discharge the firearm in response to the trigger pull; and (2) a safe position in which the first actuator lever disengages the trigger bar from the sear and rotates the safety rocker to block movement of the trigger bar each of which prevents the firearm from being discharged in response to the trigger pull.

2. The firearm according to claim 1, wherein the trigger bar is movable between a first position engaged with the sear, and a second position disengaged from the sear.

3. The firearm according to claim 2, wherein changing the safety mechanism from the fire position to the safe position rotates the safety rocker which disengages the trigger bar from the sear.

4. The firearm according to claim 3, wherein the first actuator lever comprises a forwardly protruding operating extension arm engaged with and operable to rotate the safety rocker between a blocking position when the safety mechanism is in the safe position, and a non-blocking position in which the safety rocker does not block movement of the trigger bar when the safety mechanism is in the fire position.

5. The firearm according to claim 4, wherein the safety rocker engages a transversely oriented blocking surface of the trigger bar to block movement thereof when the safety mechanism is in the safe position.

6. The firearm according to claim 4, wherein rotating the safety rocker from the non-blocking position to the blocking position simultaneously disengages the trigger bar from the sear.

7. The firearm according to claim 4, wherein the safety rocker is longitudinally elongated and oriented, the safety rocker comprising an open actuation recess which engages the extension arm of the first actuator lever.

8. The firearm according to claim 7, wherein the extension arm comprise a transversely oriented operating pin engaged with the actuation recess of the safety rocker.

9. The firearm according to claim 8, wherein the safety rocker has a bifurcated rear end comprising rearwardly projecting upper and lower actuation prongs which define the actuation recess, the upper actuation prong engageable with the trigger bar to block movement thereof when the safety mechanism is in the safe position.

10. The firearm according to claim 9, wherein safety rocker further comprises a forwardly projecting and elongated operating prong engaged with a disconnect hook protrusion on the trigger bar to disengage the trigger bar from the sear via rotating the safety rocker.

11. The firearm according to claim 1, wherein the striking member is a hammer pivotably movably about a hammer pin, and the safety rocker is pivotably mounted to the hammer pin.

12. The firearm according to claim 1, wherein the sear further comprises an upwardly extending operating arm which is engageable with a corresponding upwardly extending operating protrusion of the trigger bar to rotate the sear in response to the trigger pull.

13. The firearm according to claim 12, wherein the striking member is a hammer pivotably movably about a hammer pin, and the sear further comprises a primary sear catch protrusion which is engageable with a primary hammer notch on the hammer to retain the hammer in the rearward cocked position.

14. The firearm according to claim 13, further comprising a secondary sear catch arm extending forwardly from the sear and configured to engage a laterally open secondary hammer notch on the retain the hammer in the rearward cocked position in the event the primary sear catch protrusion disengages from the sear without the trigger being pulled.

15. The firearm according to claim 1, further comprising a manually movable second actuator lever fixedly coupled to the first actuator lever such that rotating the first or second actuator lever rotates the other.

16. The firearm according to claim 15, further comprising a spring-biased detent mechanism acting on the second actuator lever, the detent mechanism configured to retain the safety mechanism in the safe and fire positions.

17. The firearm according to claim 15, further comprising a slide movably mounted to the firearm for movement between a forward closed breech position and a rearward open breech position, and wherein the second actuator lever comprises a slide locking surface selectively engageable with a locking notch in the slide when the safety mechanism is in the safe position.

18. The firearm according to claim 1, wherein the trigger mechanism and the safety mechanism are mounted to a firing control insert removably disposed in the frame.

19. The firearm according to claim 1, wherein the firearm is an auto-loading pistol comprising a reciprocating slide movable between a forward closed breech position and a rearward open breech position.

20. An auto-loading pistol with dual-acting safety mechanism comprising:

a longitudinal axis;

a frame;

a firing control insert configured for removable mounting to the frame;

a slide movably mounted to the firing control insert for movement between a forward closed breech position and a rearward open breech position;

a firing mechanism mounted to the firing control insert, the firing mechanism comprising a hammer pivotably movable between forward firing and rearward cocked positions, a rotatable sear operable to retain the hammer in and release the hammer from the cocked position, a trigger, and a trigger bar operably linking the trigger to the sear, the trigger bar movable to rotate the sear and release the hammer from the cocked position via a trigger pull to discharge the firearm;

an ambidextrous manual safety mechanism comprising a pivotable first actuator lever operably coupled with the trigger bar, a pivotable second actuator lever operably coupled to first actuator lever, and a pivotably movable safety rocker operably coupled with the first actuator lever;

wherein the safety mechanism is manually changeable via moving the first or second actuator levers between: (1) a fire position in which the sear engages the trigger bar to discharge the firearm in response to the trigger pull; and (2) a safe position in which the safety mechanism disengages the trigger bar from the sear and rotates the safety rocker to block movement of the trigger bar each of which prevents the firearm from being discharged in response to the trigger pull.

21. The firearm according to claim 20, wherein the second actuator lever comprises a slide locking surface selectively engageable with a locking notch in the slide when the safety mechanism is in the safe position to lock the slide in the closed breech position.

22. The firearm according to claim 20, further comprising a spring-biased detent mechanism acting on the second actuator lever, the detent mechanism configured to retain the safety mechanism in the safe and fire positions.

23. The firearm according to claim 22, wherein the second actuator lever comprises a downwardly extending detent lobe comprising a pair of detent surfaces each selectively engageable by a spring-biased detent plunger when the safety mechanism is moved between the fire and safe positions.

24. The firearm according to claim 20, wherein moving the first or second actuator levers to change the safety mechanism from the fire position to the safe position lowers the trigger bar to disengage the sear therefrom to prevent discharging the firearm.

25. The firearm according to claim 24, wherein the first actuator lever comprises a forwardly protruding operating extension arm which rotates the safety rocker to force the trigger bar downwards and disengage the sear when the safety mechanism is moved to the safe position.

26. The firearm according to claim 25, wherein the extension arm simultaneously rotates the safety rocker from a first position in which movement of the trigger bar is not blocked, to a second position in which blocks forward movement of the trigger bar in response to the trigger pull.

27. The firearm according to claim 25, wherein the safety rocker is longitudinally elongated and comprises a rearwardly open actuation recess which receives the extension arm of the first actuator lever at least partially therein to actuate the safety rocker.

28. The firearm according to claim 20, wherein the first and second actuator levers each comprise longitudinally elongated cantilevered operating handles simultaneously movable between a lower position associated with the fire position of the safety mechanism, and an upper position associated with the safe position of the safety mechanism.

29. A method for operating a firearm safety mechanism comprising:

providing a firearm including a longitudinal axis, a striking member movable between rearward cocked and forward firing positions, a sear operable to retain the striking member in the cocked position, a trigger bar operably linking the sear to a trigger such that pulling the trigger moves the trigger bar which in turn rotates the sear to release the striking member for discharging the firearm;

setting a safety mechanism comprising an actuator lever operably interfaced with the trigger bar in a fire position, the trigger bar being in a first position engageable with the sear to actuate the sear in response to pulling the trigger;

moving the actuator lever to place the safety mechanism in a safe position;

rotating a safety rocker of the safety mechanism with the actuator lever;

moving the trigger bar to a second position via rotating the safety rocker, the trigger bar not being engageable with the sear to actuate the sear in response to a trigger pull; and simultaneously blocking movement of the trigger bar with the safety rocker.

30. The method according to claim 29, wherein rotating the safety rocker with actuator lever comprises raising a rear end of the safety rocker which engages the trigger bar to block movement thereof, and lowering a front end of the safety rocker which engages and moves the trigger bar to the second position.

* * * * *